US011773851B2

(12) United States Patent
Yu et al.

(10) Patent No.: US 11,773,851 B2
(45) Date of Patent: Oct. 3, 2023

(54) SCROLL COMPRESSOR INCLUDING SUCTION GUIDE

(71) Applicant: LG ELECTRONICS INC., Seoul (KR)

(72) Inventors: Byeonghun Yu, Seoul (KR); Sanghun Seong, Seoul (KR); Jinyong Jang, Seoul (KR); Byeongchul Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/721,610

(22) Filed: Apr. 15, 2022

(65) Prior Publication Data

US 2022/0333598 A1 Oct. 20, 2022

(30) Foreign Application Priority Data

Apr. 19, 2021 (KR) ..... 10-2021-0050620
Jan. 28, 2022 (KR) ..... 10-2022-0013539

(51) Int. Cl.
*F04C 18/02* (2006.01)
*F04C 29/12* (2006.01)
(Continued)

(52) U.S. Cl.
CPC ..... *F04C 18/0261* (2013.01); *F04C 29/12* (2013.01); *F04C 18/0215* (2013.01);
(Continued)

(58) Field of Classification Search
CPC .. F04C 18/0261; F04C 29/12; F04C 18/0215; F04C 23/008; F04C 29/045;
(Continued)

(56) References Cited

U.S. PATENT DOCUMENTS 5,055,010 A * 10/1991 Logan ..... F04C 23/008 418/55.6
5,240,391 A * 8/1993 Ramshankar ..... F04C 29/045 417/372
(Continued)

FOREIGN PATENT DOCUMENTS

JP 2001-099080 4/2001
JP 2014-066472 4/2014
(Continued)

OTHER PUBLICATIONS

Korean Office Action dated May 24, 2022 issued in Application No. 10-2021-0050620.
(Continued)

*Primary Examiner* — Dominick L Plakkoottam
*Assistant Examiner* — Paul W Thiede
(74) *Attorney, Agent, or Firm* — KED & ASSOCIATES

(57) ABSTRACT

A scroll compressor is disclosed. The scroll compressor may include a suction guide between a refrigerant suction pipe and a high/low pressure separation plate, and the suction guide may be fastened to a non-orbiting scroll or inserted into a suction guide protrusion that extends from the non-orbiting scroll. Accordingly, suction refrigerant may be partially suctioned into a compression chamber by the suction guide in advance before moving to the high/low pressure separation plate, so as to be prevented from coming into contact with the high/low pressure separation plate, while the suction refrigerant may also partially flow toward a drive motor without being suctioned directly into the compression chamber, so as to cool the drive motor, whereby efficiency of the compressor may be improved and an operation range of the compressor may be expanded.

19 Claims, 19 Drawing Sheets

(51) Int. Cl.
*F04C 23/00* (2006.01)
*F04C 29/04* (2006.01)

(52) U.S. Cl.
CPC ..... *F04C 23/008* (2013.01); *F04C 29/045* (2013.01); *F04C 2240/30* (2013.01); *F04C 2240/40* (2013.01); *F04C 2240/50* (2013.01); *F04C 2240/806* (2013.01); *F05C 2251/046* (2013.01)

(58) Field of Classification Search
CPC ..... F04C 2240/30; F04C 2240/40; F04C 2240/50; F04C 2240/806; F05C 2251/046
See application file for complete search history.

(56) References Cited

U.S. PATENT DOCUMENTS 5,366,352 A * 11/1994 Deblois ..... F04B 39/066 417/292
2004/0126258 A1* 7/2004 Lai ..... F04C 29/045 418/55.1
2006/0245967 A1 11/2006 Gopinathan
2007/0183914 A1 8/2007 Gopinathan
2010/0021330 A1 1/2010 Haller
2016/0298885 A1 10/2016 Doepker et al.
2019/0041107 A1* 2/2019 Piscopo ..... F04C 23/008
2020/0158110 A1 5/2020 Cho et al.
2020/0309124 A1 10/2020 King

FOREIGN PATENT DOCUMENTS

KR 10-1997-0062348 9/1997
KR 10-2015-0126499 11/2015

OTHER PUBLICATIONS

European Search Report issued in Application No. 22168756.9 dated Sep. 27, 2022.

* cited by examiner

SCROLL COMPRESSOR INCLUDING SUCTION GUIDE

CROSS-REFERENCE TO RELATED APPLICATION(S)

Pursuant to 35 U.S.C. § 119(a), this application claims the benefit of the earlier filing date and the right of priority to Korean Patent Applications No. 10-2021-0050620, filed in Korea on Apr. 19, 2021, and No. 10-2022-0013539, filed in Korea on Jan. 28, 2022, the contents of which are incorporated by reference herein in their entirety.

BACKGROUND

1. Field

A scroll compressor, and more particularly, a scroll compressor having a suction guide is disclosed herein.

2. Background

A scroll compressor is configured such that an orbiting scroll and a non-orbiting scroll are engaged with each other, and a pair of compression chambers is formed while the orbiting scroll performs an orbiting motion with respect to the non-orbiting scroll. The compression chambers each includes a suction pressure chamber that is formed at an outer side, and into which suction refrigerant is introduced, an intermediate pressure chamber in which the refrigerant is compressed as a volume thereof continuously decreases from the suction pressure chamber toward a center, and a discharge pressure chamber connected to a center of the intermediate pressure chamber such that the compressed refrigerant is discharged. The suction pressure chamber communicates with a suction port formed through a side surface of a non-orbiting scroll, the intermediate pressure chamber is sealed, and the discharge pressure chamber is formed in a discharge port formed through an end plate of the non-orbiting scroll.

Scroll compressors may be classified into a high-pressure scroll compressor and a low-pressure scroll compressor according to a refrigerant suction path. In the high-pressure scroll compressor, a refrigerant suction pipe is directly connected to a suction pressure chamber, so that refrigerant is directly guided to the suction pressure chamber without passing through an inner space of a casing. In the low-pressure scroll compressor, the inner space of the casing is divided into a low-pressure portion and a high-pressure portion by a high/low pressure separation plate or a discharge plenum communicating with a refrigerant discharge port. A refrigerant suction pipe is connected to the low-pressure portion such that suction refrigerant at a low temperature is guided into the suction pressure chamber via the inner space of the casing.

A low-pressure scroll compressor is disclosed in Korean Patent Publication No. 10-2015-0126499 (hereinafter "Patent Document 1"), which is hereby incorporated by reference and in which suction refrigerant can partially flow through the low-pressure portion and cool down a drive motor installed in the low-pressure portion, thereby improving compressor efficiency. However, in the low-pressure scroll compressor, the suction refrigerant is increased in temperature due to contact with the drive motor and then suctioned into the compression chamber. This may increase a specific volume in the suction pressure chamber, thereby causing suction loss.

Also, in the low-pressure scroll compressor, while suction refrigerant which doesn't contact the drive motor as well as the suction refrigerant in contact with the drive motor is suctioned into the suction pressure chamber, such refrigerant may be heated by being brought into contact with a high/low separation plate (or discharge plenum) exposed in a high-pressure portion or heated by radiant heat transmitted through the high/low pressure separation plate (or discharge plenum). This may increase a specific volume of the refrigerant, thereby causing suction loss.

Accordingly, in the related art, as in US Patent Publication No. US2016/0298885 A1 (hereinafter "Patent Document 2"), which is hereby incorporated by reference, a low-pressure scroll compressor having a suction conduit in a low-pressure portion of a casing has been proposed. In Patent Document 2, the suction conduit is disposed between a refrigerant suction pipe and a suction port to guide refrigerant passing through the refrigerant suction pipe to a compression chamber. As an inlet of the suction conduit is spaced apart from the refrigerant suction pipe, some of the refrigerant passing through the refrigerant suction pipe is allowed to be introduced into the low-pressure portion of the casing before being suctioned into the compression chamber.

However, in Patent Document 2 as described above, the inlet of the suction conduit faces an outlet of the refrigerant suction pipe, and thus, most of the refrigerant passing through the refrigerant suction pipe is suctioned into the compression chamber through the suction conduit. As a result, an amount of refrigerant introduced into the low-pressure portion of the casing may be greatly decreased, which may deteriorate a cooling effect of a drive motor. This may narrow an operation region due to overheating of the drive motor.

BRIEF DESCRIPTION OF THE DRAWINGS

Embodiments will be described in detail with reference to the following drawings in which like reference numerals refer to like elements, and wherein.

DETAILED DESCRIPTION

Description will now be given of a scroll compressor according to exemplary embodiments disclosed herein, with reference to the accompanying drawings. As described above, scroll compressors may be classified into a high-pressure scroll compressor and a low-pressure scroll compressor according to a refrigerant suction path. In the low-pressure scroll compressor, an inner space of a casing may be divided into a low-pressure portion and a high-pressure portion by a high/low pressure separation plate or a discharge plenum and a refrigerant suction pipe may communicate with the low-pressure portion. Hereinafter, a low-pressure scroll compressor equipped with a high/low pressure separation plate will be described as an example.

In addition, scroll compressors may be classified into a vertical scroll compressor in which a rotational shaft is disposed perpendicular to the ground and a horizontal scroll compressor in which a rotational shaft is disposed parallel to the ground. Hereinafter, a vertical scroll compressor will be described as an example. Accordingly, hereinafter, an upper side may be defined as an opposite side to the ground, and a lower side may be defined as a side facing the ground.

Figure 1:
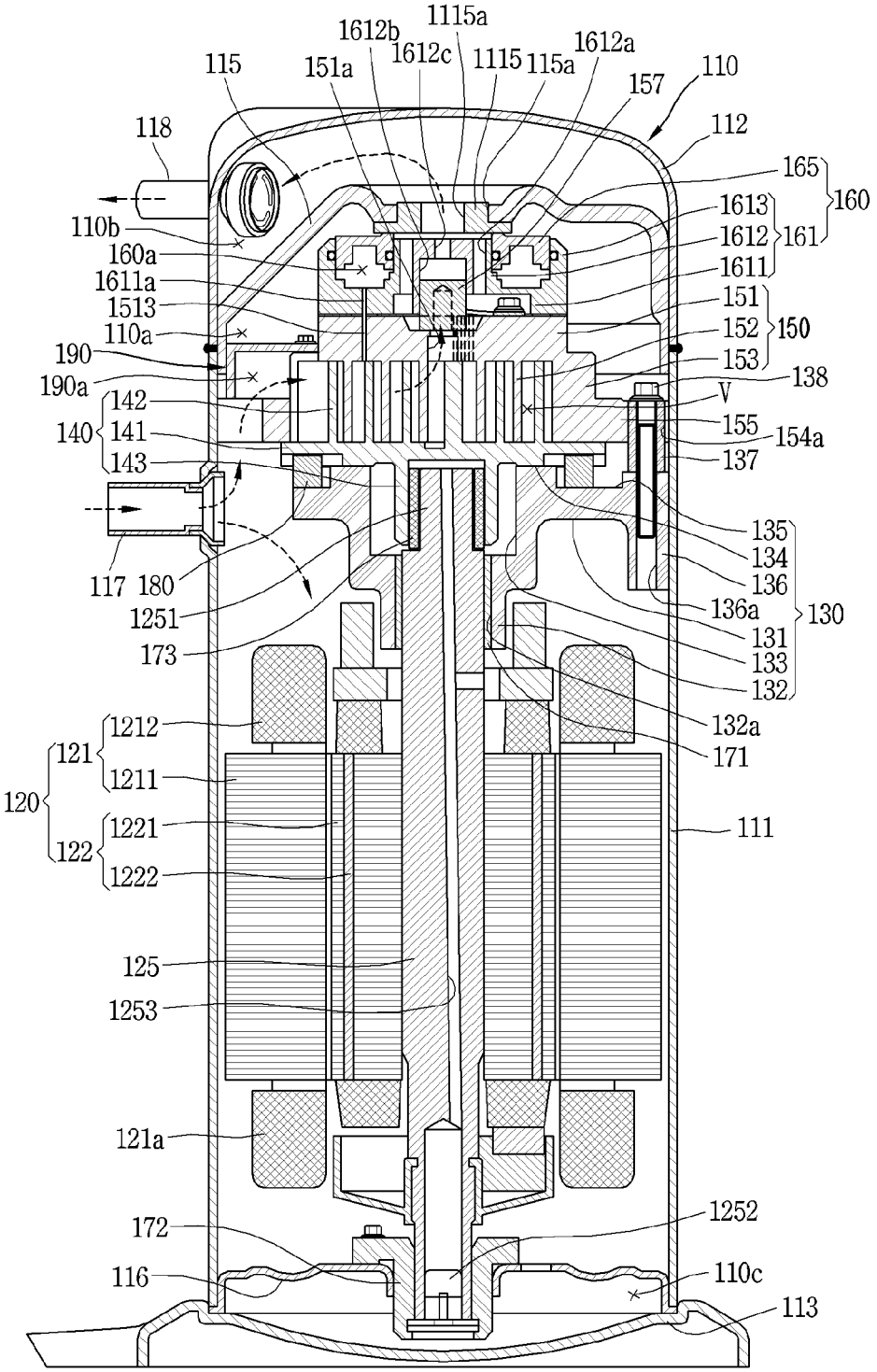
FIG. 1 is a longitudinal sectional view illustrating an inner structure of a scroll compressor in accordance with an embodiment.
Figure 2:
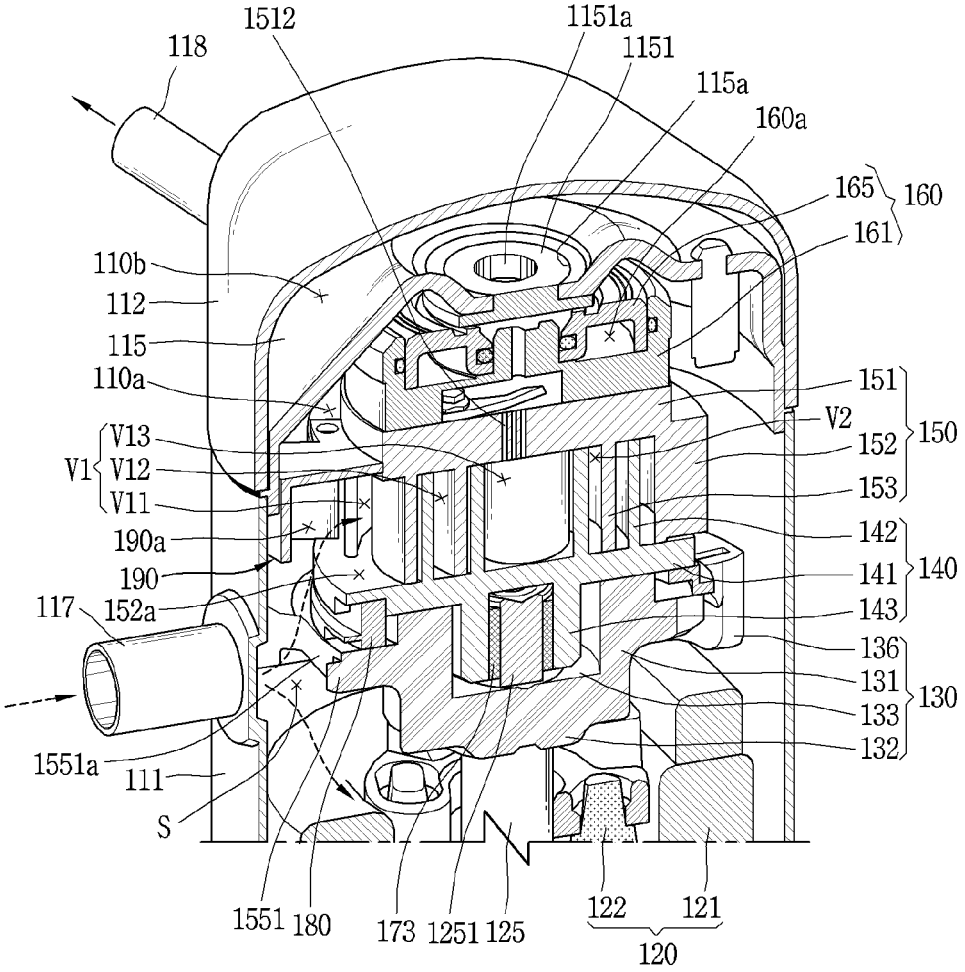
FIG. 2 is a cutout perspective view illustrating a portion of the scroll compressor according to FIG. 1.
Figure 3:
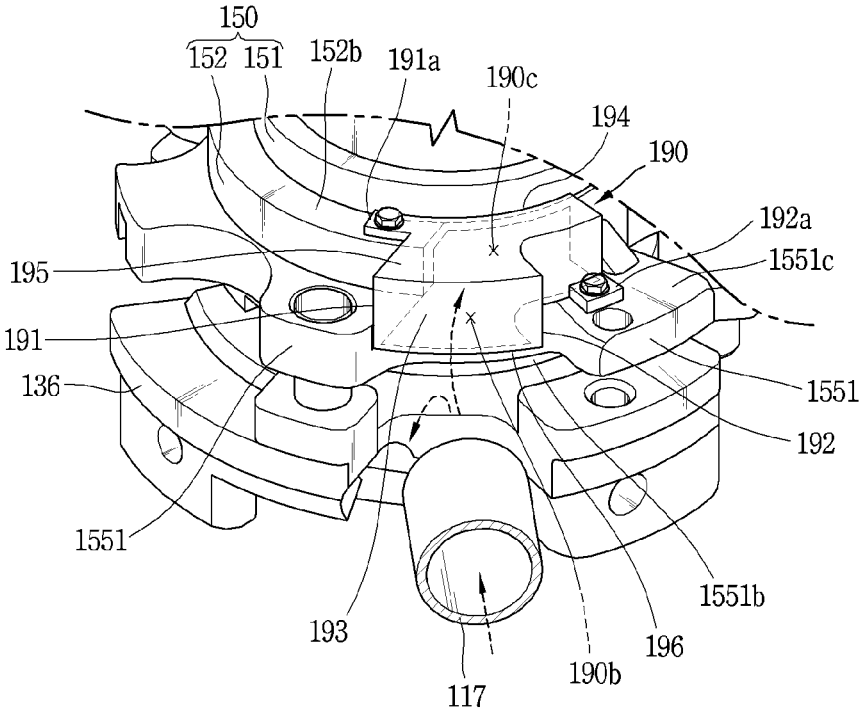
FIG. 3 is a perspective view illustrating a portion of a compression unit of FIG. 2.

FIG. 1 is a longitudinal sectional view illustrating an inner structure of a scroll compressor in accordance with an embodiment, FIG. 2 is a cutout perspective view illustrating a portion of the scroll compressor according to FIG. 1, and FIG. 3 is a perspective view illustrating a portion of a compression unit of FIG. 2.

Referring to FIGS. 1 to 2, a scroll compressor according to an embodiment may include a drive motor 120 disposed in a lower half portion of a casing 110, and a main frame 130, an orbiting scroll 140, a non-orbiting scroll 150, and a discharge pressure chamber assembly 160 that are sequentially disposed at an upper side of the drive motor 120. In general, the drive motor 120 may form a motor unit, and the main frame 130, the orbiting scroll 140, the non-orbiting scroll 150, and the back pressure chamber assembly 160 may form a compression unit. The motor unit may be coupled to one or a first end of a rotational shaft 125, and the compression unit may be coupled to another or a second end of the rotational shaft 125. Accordingly, the compression unit may be connected to the motor unit by the rotational shaft 125 to be operated by a rotational force of the motor unit.

The casing 110 may include a cylindrical shell 111, an upper cap 112, and a lower cap 113. The cylindrical shell 111 may have a cylindrical shape with open upper and lower ends, and the drive motor 120 and the main frame 130 may be fitted to an inner circumferential surface of the cylindrical shell 111, for example, in an inserting manner. A terminal bracket (not shown) may be coupled to an upper portion of the cylindrical shell 111, and a terminal (not shown) that transmits external power to the drive motor 120 may be coupled through the terminal bracket. In addition, a refrigerant suction pipe 117 described hereinafter may be coupled to the upper portion of the cylindrical shell 111, for example, above the drive motor 120.

The upper cap 112 may be coupled to cover the open upper end of the cylindrical shell 111, and the lower cap 113 may be coupled to cover the open lower end of the cylindrical shell 111. A rim of a high/low separation plate 115 described hereinafter may be inserted between the cylindrical shell 111 and the upper cap 112 and may be, for example, welded to the cylindrical shell 111 and the upper cap 112, and a rim of a support bracket 116 described hereinafter may be inserted between the cylindrical shell 111 and the lower cap 113 and may be, for example, welded to the cylindrical shell 111 and the lower cap 113. Accordingly, an inner space of the casing 110 may be sealed.

The rim of the high/low pressure separation plate 115, as aforementioned, may be, for example, welded to the casing 110 and a central portion of the high/low separation plate 115 may be bent to protrude toward the upper cap 112 so as to be disposed above the back pressure chamber assembly 160. The refrigerant suction pipe 117 may communicate with a space below the high/low pressure separation plate 115, and a refrigerant discharge pipe 118 may communicate with a space above the high/low separation plate 115. Accordingly, a low-pressure part or portion 110*a* forming a suction space may be formed below the high/low pressure separation plate 115, and a high-pressure part or portion 110*b* forming a discharge space may be formed above the high/low pressure separation plate 115.

In addition, a through hole 115*a* may be formed through a center of the high/low pressure separation plate 115, and a sealing plate 1151 to which a floating plate 165 described hereinafter is detachably coupled may be inserted into the through hole 115*a*. Accordingly, the low-pressure portion 110*a* and the high-pressure portion 110*b* may be blocked from or communicate with each other by attachment and detachment of the floating plate 165 and the sealing plate 1151.

The sealing plate 1151 may be formed in an annular shape. For example, a high/low pressure communication hole 1151*a* may be formed through a center of the sealing plate 1151 so that the low-pressure portion 110*a* and the high-pressure portion 110*b* communicate with each other. The floating plate 165 may be attachable and detachable along a circumference of the high/low pressure communication hole 1151*a*. Accordingly, the floating plate 165 may be attached to or detached from a circumference of the high/low pressure communication hole 1151*a* of the sealing plate 1151 while moving up and down by back pressure in an axial direction. During this process, the low-pressure portion 110*a* and the high-pressure portion 110*b* may be sealed from each other or communicate with each other.

In addition, the lower cap 113 may define an oil storage space 110*c* together with the lower portion of the cylindrical shell 111 forming the low-pressure portion 110*a*. In other words, the oil storage space 110*c* may be defined in the lower portion of the low-pressure portion 110*a*. The oil storage space 110*c* may define a portion of the low-pressure portion 110*a*.

Hereinafter, the drive motor will be described.

Referring to FIG. 1, the drive motor 120 according to an embodiment may be disposed in the lower portion of the low-pressure portion 110*a* and include a stator 121 and a rotor 122. The stator 121 may be, for example, shrink-fitted to an inner wall surface of the casing 111, and the rotor 122 may be rotatably provided inside of the stator 121.

The stator 121 may include a stator core 1211 and a stator coil 1212. The stator core 1211 may be formed in a cylindrical shape and may be shrink-fitted onto the inner circumferential surface of the cylindrical shell 111. The stator coil 1212 may be wound around the stator core 1211 and may be electrically connected to an external power source through a terminal (not shown) that is coupled through the casing 110.

The rotor 122 may include a rotor core 1221 and permanent magnets 1222. The rotor core 1221 may be formed in a cylindrical shape, and may be rotatably inserted into the stator core 1211 with a preset or predetermined gap therebetween. The permanent magnets 1222 may be embedded in the rotor core 1222 at preset or predetermined intervals along a circumferential direction.

The rotational shaft 125 may be coupled to a center of the rotor 122. An upper end portion of the rotational shaft 125 may be rotatably inserted into the main frame 130 described hereinafter so as to be supported in a radial direction, and a lower end portion of the rotational shaft 125 may be rotatably inserted into support bracket 116 to be supported in the radial and axial directions. The main frame 130 may be provided with a main bearing 171 that supports the upper end portion of the rotational shaft 125, and the support bracket 116 may be provided with a sub bearing 172 that supports the lower end portion of the rotational shaft 125. The main bearing 171 and the sub bearing 172 each may be a bush bearing.

An eccentric portion 1251 that is eccentrically coupled to the orbiting scroll 140 described hereinafter may be formed on the upper end portion of the rotational shaft 125, and an oil feeder 1252 that absorbs oil stored in the lower portion of the casing 110 may be disposed in the lower end portion of the rotational shaft 125. An oil supply hole 1253 may be formed through the rotational shaft 125 in the axial direction.

Next, the main frame will be described.

The main frame 130 according to this embodiment may be disposed above the drive motor 120 and may be, for example, shrink-fitted or welded to an inner wall surface of the cylindrical shell 111. Referring to FIGS. 1 to 3, the main frame 130 may include a main flange portion 131, a main bearing portion 132, an orbiting space portion 133, a scroll support portion 134, an Oldham ring accommodation portion 135, and a frame fixing portion 136.

The main flange portion 131 may be formed in an annular shape and accommodated in the low-pressure portion 110*a* of the casing 110. An outer diameter of the main flange portion 131 may be formed smaller than an inner diameter of the cylindrical shell 111 so that an outer circumferential surface of the main flange portion 131 is spaced apart from the inner circumferential surface of the cylindrical shell 111. However, the frame fixing portion 136 described hereinafter may protrude from an outer circumferential surface of the main flange portion 131 in the radial direction, and an outer circumferential surface of the frame fixing portion 136 may be brought into close contact with and fixed to the inner circumferential surface of the casing 110. Accordingly, the frame 130 may be fixedly coupled to the casing 110.

The main bearing portion 132 may protrude downward from a lower surface of a central portion of the main flange portion 131 toward the drive motor 120. The main bearing portion 132 may be provided with a bearing hole 132*a* formed therethrough in a cylindrical shape along an axial direction, and the main bearing 171 configured as the bush bearing may be fixedly coupled to an inner circumferential surface of the bearing hole 132 in an inserted manner. The rotational shaft 125 may be inserted into the main bearing 171 to be supported in the radial direction.

The orbiting space portion 133 may be recessed from the center portion of the main flange portion 131 toward the main bearing portion 132 to a predetermined depth and outer diameter. The orbiting space portion 133 may be larger than an outer diameter of a rotational shaft coupling portion 143 provided on the orbiting scroll 140 described hereinafter. Accordingly, the rotational shaft coupling portion 143 may be pivotally accommodated in the orbiting space portion 133.

The scroll support portion 134 may be formed in an annular shape on an upper surface of the main flange portion 131 along a periphery of the orbiting space portion 133. Accordingly, the scroll support portion 134 may support a lower surface of an orbiting end plate 141 described hereinafter in the axial direction.

The scroll support portion 135 may be formed in an annular shape on an upper surface of the main flange portion 131 along an outer circumferential surface of the orbiting space portion 134. Accordingly, an Oldham ring 180 may be inserted into the Oldham ring accommodation portion 135 to be pivotable.

The frame fixing portion 136 may extend radially from an outer periphery of the Oldham ring accommodation portion 135. The frame fixing portion 136 may extend in an annular shape or may extend to form a plurality of protrusions spaced apart from one another by preset or predetermined intervals. This embodiment illustrates an example in which the frame fixing portion 136 has a plurality of protrusions along a circumferential direction.

For example, a plurality of the frame fixing portion 136 may be provided disposed at preset or predetermined intervals along the circumferential direction. The plurality of frame fixing portions 136 may be provided with bolt coupling holes 136*a*, respectively, that are formed therethrough in the axial direction.

The frame fixing portions 136 may correspond to respective guide protrusions 155 of the non-orbiting scroll 150 described hereinafter in the axial direction, and the bolt coupling holes 136*a* may be formed to correspond to respective guide insertion holes 154*a* described hereinafter in the axial direction. An inner diameter of the bolt coupling hole 136*a* may be smaller than an inner diameter of the guide insertion hole 154*a*. Accordingly, a stepped surface that extends from an inner circumferential surface of the guide insertion hole 154*a* may be formed on a periphery of an upper surface of the bolt coupling hole 136*a*, and a guide bush 137 that is inserted through the guide insertion hole

154*a* may be placed on the stepped surface so as to be supported on the frame fixing portion 136 in the axial direction.

The guide bush 137 may be formed in a hollow cylindrical shape through which the bolt insertion hole 137*a* is formed in the axial direction. Each guide bolt 138 may be inserted through the bolt insertion hole 137*a* of the guide bush 137 to be coupled to the bolt coupling hole 136*a* of the frame fixing portion 136. The non-orbiting scroll 150 may thus be slidably supported on the main frame 130 in the axial direction and fixed to the main frame 130 in the radial direction.

As described above, as the frame fixing portions 136 are formed at the preset or predetermined intervals along the circumferential direction, a kind of suction guide space S may be defined between the adjacent frame fixing portions 136. Accordingly, a refrigerant suctioned into the low-pressure portion 110*a* may be guided to a suction guide 190 described hereinafter through the suction guide space S between the adjacent frame fixing portions 136. Accordingly, when viewed in the axial direction, the refrigerant suction pipe 117 and the suction guide 190 may be formed within a range of the suction guide space S to reduce flow resistance. This will be described hereinafter together with the suction guide 190.

Hereinafter, the orbiting scroll will be described.

The orbiting scroll 140 according to the embodiment may be disposed on an upper surface of the main frame 130. The Oldham ring 180, which is an anti-rotation mechanism, may be provided between the orbiting scroll 140 and the main frame 130 or between the orbiting scroll 140 and the non-orbiting scroll 150 described hereinafter so that the orbiting scroll 140 performs an orbiting motion.

Referring to FIGS. 1 and 2, the orbiting scroll 140 according to the embodiment may include the orbiting end plate 141, an orbiting wrap 142, and the rotational shaft coupling portion 143. The orbiting end plate 141 may be formed approximately in a disk shape.

The orbiting wrap 142 may be formed in a spiral shape and protrude from an upper surface of the orbiting end plate 141 facing the non-orbiting scroll 150 to a preset or predetermined height. The orbiting wrap 142 may correspond to the non-orbiting wrap 153 to perform an orbiting motion by being engaged with a non-orbiting wrap 153 of the non-orbiting scroll 150 described hereinafter. The orbiting wrap 142 may define a compression chamber V together with the non-orbiting wrap 153.

The compression chamber V may include a first compression chamber V1 and a second compression chamber V2 based on the non-orbiting wrap 153 described hereinafter. The first compression chamber V1 may be formed at an outer surface of the non-orbiting wrap 152, and the second compression chamber V2 may be formed at an inner surface of the non-orbiting wrap 152. Each of the first compression chamber V1 and the second compression chamber V2 may include a suction pressure chamber V11 (not illustrated), an intermediate pressure chamber V12 (not illustrated), and a discharge pressure chamber V13 (not illustrated) that are continuously formed.

The rotational shaft coupling portion 143 may protrude from a lower surface of the orbiting end plate 141 toward the main frame 130. The rotational shaft coupling portion 143 may be formed in a cylindrical shape, and an eccentric portion bearing 173 may be coupled to an inner circumferential surface of the rotational shaft coupling portion 143 in an inserted manner. The eccentric portion bearing 173 may be a bush bearing.

The Oldham ring 180 may be provided between the main frame 130 and the orbiting scroll 140 to restrict a rotational motion of the orbiting scroll 140. As described above, the Oldham ring 180 may be slidably coupled to the main frame 130 and the orbiting scroll 140, respectively, or slidably coupled to the orbiting scroll 140 and the non-orbiting scroll 150, respectively.

Hereinafter, the non-orbiting scroll will be described.

The non-orbiting scroll 150 according to the embodiment may be disposed on an upper portion of the orbiting scroll 140. The non-orbiting scroll 150 may be fixedly coupled to the main frame 130, or may be coupled to the main frame 130 to be movable up and down. The embodiment illustrates an example in which the non-orbiting scroll 150 is coupled to the main frame 130 to be movable relative to the main frame 130 in the axial direction.

Referring to FIGS. 1 to 3, the non-orbiting scroll 150 according to the embodiment may include a non-orbiting end plate 151, a non-orbiting side wall portion or side wall 152, and a non-orbiting wrap 153. The non-orbiting end plate 151 may be formed in a disk shape and disposed in a horizontal direction in the low-pressure portion 110*a* of the casing 110. A discharge port 1511, a bypass hole 151*b*, and a scroll-side back pressure hole 151*c* may be formed through a central portion of the non-orbiting end plate 151 in the axial direction.

The discharge port 151*a* may be located at a position at which a discharge pressure chamber (no reference numeral given) of the first compression chamber V1 and a discharge pressure chamber (no reference numeral given) of the second compression chamber V2 communicate with each other. The bypass hole 151*b* may communicate with the first compression chamber V1 and the second compression chamber V2, respectively. The scroll-side back pressure hole (hereinafter, "first back pressure hole") 151*c* may be spaced apart from the discharge port 151*a* and the bypass hole 151*b*. The non-orbiting side wall 152 may extend in an annular shape from an edge of a lower surface of the non-orbiting end plate 151 in the axial direction.

A suction port 152*a* may be formed through one side of an outer circumferential surface of the non-orbiting side wall 152 in a radial direction. A stepped surface (hereinafter, "first stepped surface") 152*b* may be formed at one side of the suction port 152*a* in a circumferential direction to extend in a stepped manner from an outer circumferential surface of the non-orbiting end plate 151 in the axial direction. The suction port 152*a* may be formed in an arcuate shape by a preset or predetermined length along an outer circumferential surface of the non-orbiting side wall 152. The first stepped surface 152*b* may be formed in an arcuate shape at approximately a same height as the suction port 152*a* or at a position slightly higher than the suction port 152*a*. Accordingly, a first fixing protrusion 191*a* of the suction guide 190 described hereinafter may be supported on the first stepped surface 152*b* in the axial direction, and a passage inlet 190*b* of the suction guide 190 may communicate with the suction port 152*a*.

A guide protrusion 155 may extend radially from an outer circumferential surface of a lower side of the non-orbiting side wall 152. The guide protrusion 155 may be provided with the guide insertion groove 155*a*.

A plurality of the guide protrusions 155 may be provided disposed at preset or predetermined intervals in the circumferential direction, or only one may be provided. When a plurality of the guide protrusions 155 is provided, the guide insertion holes 155*a* may be formed through the guide protrusions 155, respectively. On the other hand, when the single guide protrusion 155 is provided, the plurality of guide insertion holes 155*a* may be formed at preset or predetermined intervals in the circumferential direction. This embodiment exemplarily illustrates a case in which a plurality of the guide protrusions 155 is provided.

Referring to FIGS. 2 and 3, the suction port 152*a* may be disposed at an upper side of a guide protrusion (hereinafter, "suction-side guide protrusion") 1551, which faces the outlet end 117*a* of the refrigerant suction pipe 117 (the location of outlet end 117*a* of refrigerant suction pipe 117 is shown depicted in FIG. 10) or is adjacent to the outlet end 117*a*, among the plurality of guide protrusions 155. A suction guide groove 1551*a* may be formed in an outer circumferential surface of the suction-side guide protrusion 1551.

For example, the suction port 152*a* may be formed through an outer circumferential surface and an inner circumferential surface of the non-orbiting side wall 152, and the suction guide groove 1551*a* may be recessed by a preset or predetermined depth toward an inner circumferential side from a center of the outer circumferential surface of the suction-side guide protrusion 1551.

The suction guide groove 1551*a* may be recessed up to a middle of the suction side guide protrusion 1551 in the radial direction. Accordingly, a circumferential extension portion 1551*b* that connects both inner surfaces of the suction-side guide protrusion 1551 may be formed on the inner circumferential side of the suction guide groove 1551*a*. A side wall portion or side wall 191, 192 or a lower wall portion or lower wall 196 of the suction guide 190 described hereinafter may be placed on the circumferential extension portion 1551*b* to be supported in the axial direction. The circumferential extension portion 1551*b* may decrease a suction area due to interference with a passage inlet 190*b* of the suction guide 190, so it may be formed as narrow as possible.

Although not illustrated, the suction guide groove 1551*a* may be recessed up to a root of an inner circumferential side of the suction-side guide protrusion 1551, namely, up to the outer circumferential surface of the non-orbiting side wall 152. In this case, the circumferential extension portion 1551*b* may not be formed or minimally formed at the suction-side guide protrusion 1551, so as to reduce an area blocking the passage inlet 190*b* of the suction guide 190. In this case, flow resistance of suction refrigerant flowing toward the suction guide 190 may be reduced, so that an amount of refrigerant suctioned into the compression chamber without going through the drive motor 120 may be increased.

In addition, although not illustrated, the suction port 152*a* may not be formed at the middle of the suction-side guide protrusion 1551, but may be formed between adjacent guide protrusions 155 in the circumferential direction among the plurality of guide protrusions 155. In this case, the circumferential extension portion 1551*b* may not be formed between the adjacent guide protrusions 155, but a space between the guide protrusions 155 may define a kind of suction guide space, thereby increasing the suction area.

On the other hand, the suction port 152*a* and the suction guide groove 1551*a* may overlap each other substantially on a same line in the radial direction when projected in the axial direction, and the refrigerant suction pipe 117 may be at least partially disposed within a circumferential range of the suction port 152*a* and the suction guide groove 1551*a*. Accordingly, refrigerant, which is not directed to the drive motor 120, of refrigerants suctioned into the low-pressure portion 110*a* of the casing 110 through the refrigerant suction pipe 117 may quickly flow into the suction guide 190 described hereinafter through the suction guide groove 1551*a*. This will be described hereinafter together with the suction guide 190.

The non-orbiting wrap 153 may be formed in a spiral shape, and may be formed to correspond to the orbiting wrap 142 so as to be engaged with the orbiting wrap 142. A description of the non-orbiting wrap 153 may be the same as the description of the orbiting wrap 142, and thus, repetitive description has been omitted.

The back pressure chamber assembly 160 according to the embodiment may be installed on an upper side of the non-orbiting scroll 150. Accordingly, the non-orbiting scroll 150 may be pressed toward the orbiting scroll 140 by back pressure of a back pressure chamber S (accurately, a force that back pressure is applied to the back pressure chamber), so as to seal the compression chamber V.

Referring to FIGS. 1 and 2, the back pressure chamber assembly 160 may include a back pressure plate 161 and floating plate 165. The back pressure plate 161 may be coupled to an upper surface of the non-orbiting end plate 151 and the floating plate 165 may be slidably coupled to the back pressure plate 161 to define a back pressure chamber 160*a* together with the back pressure plate 161.

The back pressure plate 161 may include a fixed end plate portion or plate 1611, a first annular wall portion or wall 1612, and a second annular wall portion or wall 1613. The fixed end plate 1611 may be formed in an annular plate shape with a hollow center, and a plate-side back pressure hole (hereinafter, referred to as a "second back pressure hole") 1611*a* may be formed through the fixed end plate 1611 in the axial direction. The second back pressure hole 1611*a* may communicate with the first back pressure hole 151*c* so as to communicate with the back pressure chamber 160*a*. Accordingly, the second back pressure hole 1611*a* may communicate with the first back pressure hole 151*c* so that the compression chamber V and the back pressure chamber 160*a* may communicate with each other.

The first annular wall 1612 and the second annular wall 1613 may be formed on an upper surface of the fixed end plate 1611 to surround inner and outer circumferential surfaces of the fixed end plate 1611. An outer circumferential surface of the first annular wall 1612, an inner circumferential surface of the second annular wall 1613, the upper surface of the fixed end plate 1611, and a lower surface of the floating plate 165 may define the back pressure chamber S in the annular shape.

The first annular wall 1612 may be provided with an intermediate discharge port 1612*a* that communicates with the discharge port 151*a* of the non-orbiting scroll 150, a valve guide groove 1612*b* in which a check valve 157 is slidably inserted may be formed in the intermediate discharge port 1612*a*, and a backflow prevention hole 1612*c* may be formed in a central portion of the valve guide groove 1612*b*. Accordingly, the check valve 157 may be selectively opened and closed between the discharge port 151*a* and the intermediate discharge port 1612*a* to suppress a discharged refrigerant from flowing back into the compression chamber.

The floating plate 165 may be formed in an annular shape and may be formed of a lighter material than the back pressure plate 161. Accordingly, the floating plate 165 may be attached to and detached from a lower surface of the high/low pressure separation plate 115 while moving in the axial direction with respect to the back pressure plate 161 depending on a pressure of the back pressure chamber 160*a*. For example, when the floating plate 165 is brought into contact with the high/low pressure separation plate 115, the floating plate 165 may serve to seal the low-pressure portion

110*a* such that the discharged refrigerant is discharged to the high-pressure portion 110*b* without leaking into the low-pressure portion 110*a*.

The scroll compressor according to the embodiment may operate as follows.

When power is applied to the stator coil 1212 of the stator 121, the rotor 122 may rotate together with the rotational shaft 125. Then, the orbiting scroll 140 coupled to the rotational shaft 125 may perform the orbiting motion with respect to the non-orbiting scroll 150, thereby forming a pair of compression chambers V between the orbiting wrap 142 and the non-orbiting wrap 153. The compression chamber V may gradually decrease in volume while moving from outside to inside according to the orbiting motion of the orbiting scroll 140.

At this time, the refrigerant may be suctioned into the low-pressure portion 110*a* of the casing 110 through the refrigerant suction pipe 117. A portion of this refrigerant may be suctioned directly into the suction pressure chambers V11 (no reference numerals given) of the first compression chamber V1 and the second compression chamber V2, respectively, while the rest of the refrigerant may first flow toward the drive motor 120 and then be suctioned into the suction pressure chambers V11. This will be described hereinafter.

Then, the refrigerant may be compressed while moving along a movement path of the compression chamber V. A portion of the compressed refrigerant may move toward the back pressure chamber 160*a* through the first back pressure hole 151*c* before reaching the discharge port 151*a*. Accordingly, the back pressure chamber 160*a* formed by the non-orbiting end plate 161 and the floating plate 165 may form an intermediate pressure.

Then, the floating plate 165 may rise toward the high/low pressure separation plate 115 to be brought into close contact with the sealing plate 1151 provided on the high/low pressure separation plate 115. The high-pressure portion 110*b* of the casing 110 may be separated from the low-pressure portion 110*a*, to prevent the refrigerant discharged from each compression chamber V1 and V2 from flowing back into the low-pressure portion 110*a*.

On the other hand, the back pressure plate 161 may be lowered by the pressure of the back pressure chamber 160*a* applied toward the non-orbiting scroll 150, so as to press the non-orbiting scroll 150 toward the orbiting scroll 140. Accordingly, the non-orbiting scroll 150 may be closely adhered on the orbiting scroll 140 to prevent the compressed refrigerant from leaking from the high-pressure side compression chamber, which forms an intermediate pressure chamber, to a low-pressure side compression chamber.

At this time, the refrigerant may be compressed up to a preset or predetermined pressure while moving from the intermediate pressure chamber to the discharge pressure chamber, but the pressure of the refrigerant may rise above the preset or predetermined pressure due to other conditions occurred during operation of the compressor. Then, some of the refrigerant moving from the intermediate pressure chamber to the discharge pressure chamber may be bypassed in advance from the intermediate pressure chamber forming each compression chamber V1 and V2 toward the high-pressure portion 110*b* through the bypass hole 151*b* before reaching the discharge pressure chamber. Then, the refrigerant may be prevented from being excessively compressed over the preset or predetermined pressure in the compression chamber, thereby enhancing efficiency of the compressor and ensuring stability of the compressor.

The refrigerant moved to the discharge pressure chamber may be discharged to the high-pressure portion 110*b* through the discharge port 151*a* and the intermediate discharge port 1612*a* while pushing the discharge valve 157. The refrigerant may be filled in the high-pressure portion 110*b* and then discharged through a condenser of a refrigeration cycle via the refrigerant discharge pipe 118. The series of processes may be repetitively carried out.

The refrigerant discharged to the high-pressure portion 110*b* may be in a high-temperature and high-pressure state. The refrigerant in the high-temperature and high-pressure state may be brought into contact with the upper cap 112 and the high/low pressure separation plate 115 forming the high-pressure portion 110*b* to heat the upper cap 112 and the high/low pressure separation plate 115. In particular, as the high/low pressure separation plate 115 serves to divide the inner space of the casing 110 into the low-pressure portion 110*a* and the high-pressure portion 110*b*, the temperature of the high/low pressure separation plate 115 may be remarkably increased by the refrigerant discharged to the high-pressure portion 110*b* during operation of the compressor.

When the temperature of the high/low pressure separation plate 115 is increased, the suction refrigerant suctioned into the low-pressure portion 110*a* may partially be brought into contact with the high/low pressure separation plate 115 before being suctioned into the compression chamber V, so as to receive conductive heat or be heated by radiant heat generated from the high/low pressure separation plate 115. A specific volume of the suction refrigerant may increase, thereby reducing an amount of refrigerant suctioned into the compression chamber and lowering compressor efficiency.

Accordingly, in this embodiment, the suction guide 190 may be disposed at an inlet of the compression chamber, namely, between the refrigerant suction pipe 117 and the high/low pressure separation plate 115, to prevent the suction refrigerant from being heated directly or indirectly by the high/low pressure separation plate 115. With the configuration, the increase in specific volume of the refrigerant suctioned into the compression chamber may be suppressed, and thus, an amount of refrigerant suctioned into the compression chamber may increase, thereby improving efficiency of the compressor. In addition, in this embodiment, the suction guide 190 may be provided to guide a portion of the suction refrigerant to flow toward the drive motor 120. Accordingly, some of the suction refrigerant may be guided toward the drive motor 120 so as to prevent overheating the drive motor 120, thereby further improving efficiency of the compressor and simultaneously preventing a reduction of an operation-allowed region (operation range) due to the overheat of the drive motor 120.

Figure 4:
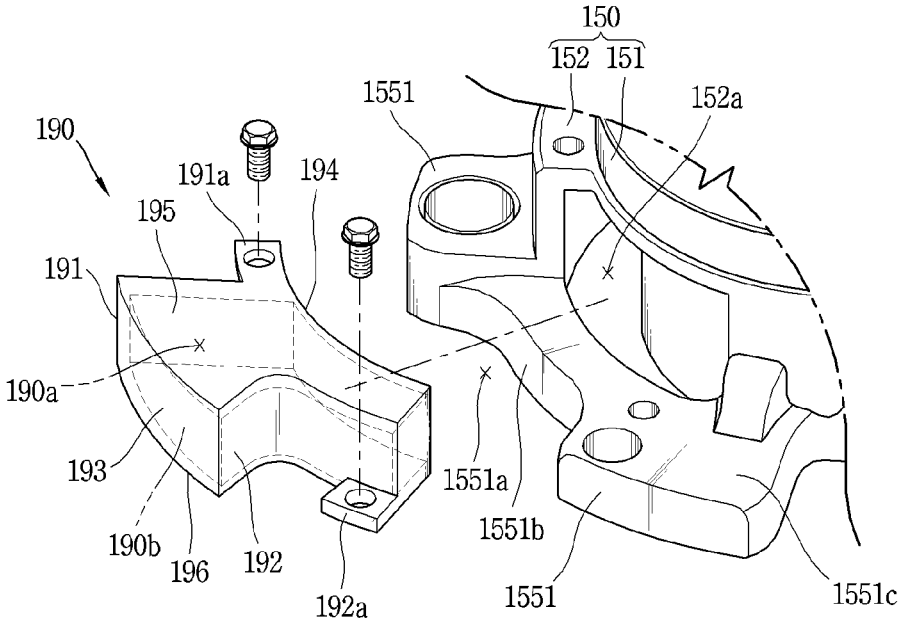
FIG. 4 is a detached perspective view illustrating a suction guide in accordance with an embodiment.
Figure 5:
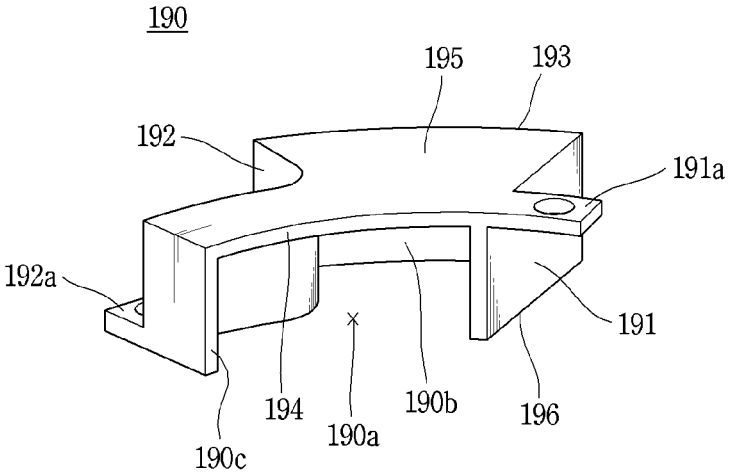
FIG. 5 is a perspective view illustrating the suction guide of FIG. 4, viewed from the inside.
Figure 6:
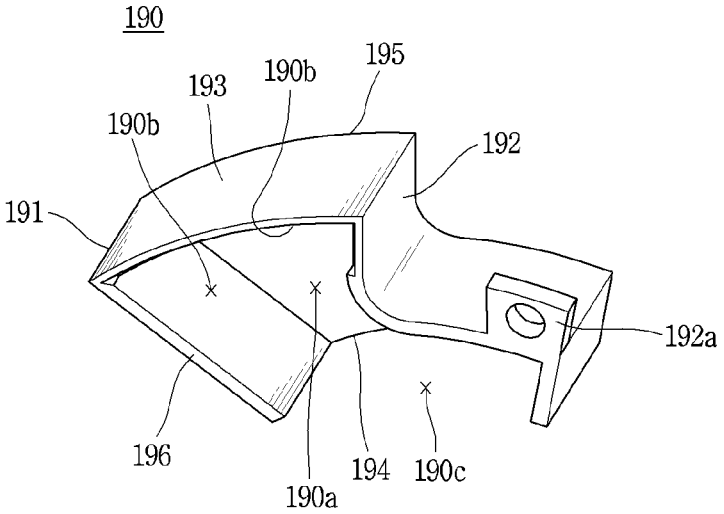
FIG. 6 is a perspective view illustrating the suction guide of FIG. 5, viewed from the outside.
Figure 7:
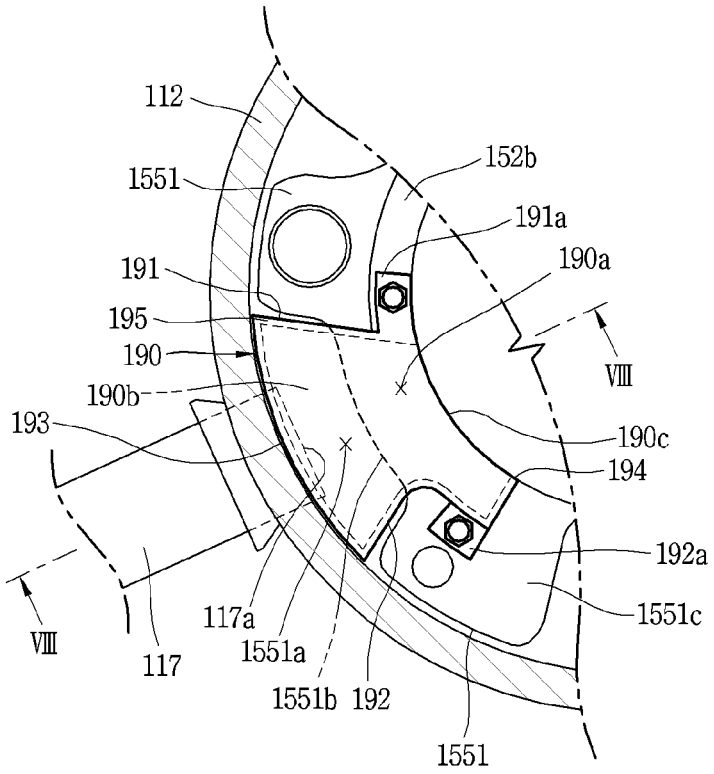
FIG. 7 is a planar view illustrating an assembled state of the suction guide in accordance with the embodiment.
Figure 8:
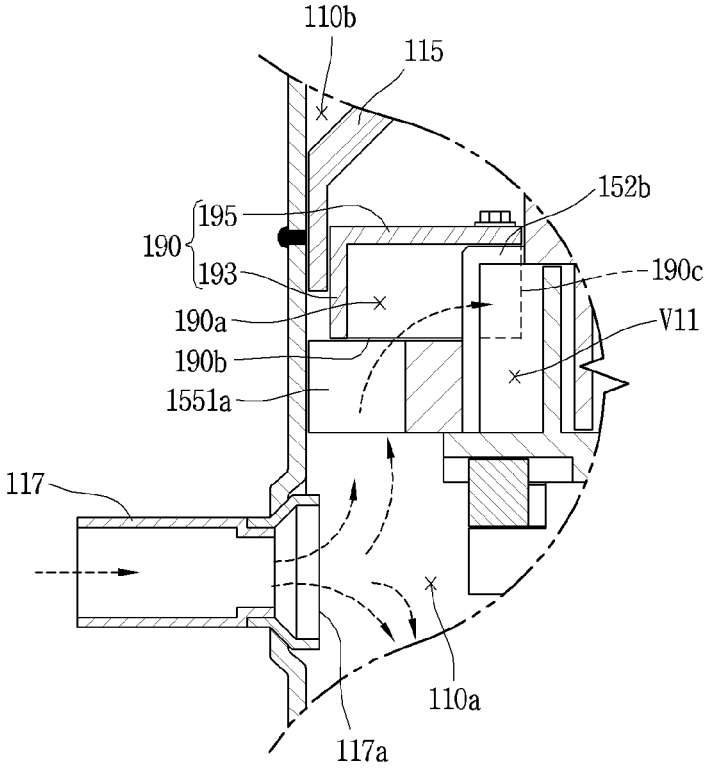
FIG. 8 is a cross-sectional view, taken along line "VIII-VIII" of FIG. 7.

FIG. 4 is a detached perspective view illustrating a suction guide in accordance with an embodiment. FIG. 5 is a perspective view illustrating the suction guide of FIG. 4, viewed from the inside. FIG. 6 is a perspective view illustrating the suction guide of FIG. 5, viewed from the outside. FIG. 7 is a planar view illustrating an assembled state of the suction guide in accordance with the embodiment. FIG. 8 is a cross-sectional view, taken along line "VIII-VIII" of FIG. 7.

Referring to these drawings, the suction guide 190 according to the embodiment may be disposed between the refrigerant suction pipe 117 and the high/low pressure separation plate 115. In other words, the suction guide 190 may be located lower than the high/low pressure separation plate 115 but higher than the refrigerant suction pipe 117. Accordingly, the suction refrigerant suctioned into the low-pressure portion 110*a* of the casing 110 through the refrigerant suction pipe 117 may be blocked by the suction guide 190, so as to be suppressed from flowing toward the high/low pressure separation plate 115. This may prevent the suction refrigerant from being heated by the high/low pressure separation plate 115 directly or indirectly.

The suction guide 190 according to the embodiment may be manufactured separately and coupled to the non-orbiting scroll 150. Accordingly, the suction guide 190 may be made of a material different from that of the non-orbiting scroll 150, for example, a material having low thermal conductivity, such as Teflon. This may prevent the suction refrigerant passing through the suction guide 190 from being heated by radiant heat transmitted through the high/low pressure separation plate 115.

In addition, as the suction guide 190 is manufactured separately from the non-orbiting scroll 150, a shape of the suction guide 190 may vary depending on surrounding conditions. This may more effectively suppress the suction refrigerant from moving toward the high/low pressure separating plate 115 without flowing into the suction guide 190.

The suction guide 190 according to this embodiment may be a single body and formed substantially in a hexahedral hollow box shape. For example, the suction guide 190 may include a first side wall portion or sidewall 191, a second side wall portion or sidewall 192, an outer wall portion or outer wall 193, an inner wall portion or inner wall 194, an upper wall portion or upper wall 195, and a lower wall portion or lower wall 196. Among these wall portions or walls, the first side wall 191, the second side wall 192, the outer wall 193, and the upper wall 195 may define a suction passage 190*a*. Also, the lower wall 196 may define a passage inlet 190*b*, which is an inlet of the suction passage 190*a*, and the inner wall 194 may define a passage outlet 190*c*, which is an outlet of the suction passage 190*a*.

The first side wall 191 and the second side wall 192 may be located at both sides of the suction port 152*a* in the circumferential direction, respectively, and extend toward the inner circumferential surface of the cylindrical shell 111 defining the casing 110 substantially in the radial direction. For example, the first side wall 191 and the second side wall 192 may be formed in a shape substantially corresponding to both side surfaces of the suction guide groove 1551*a* at the suction-side guide protrusion 1551.

The suction guide groove 1551*a* according to this embodiment may be formed shorter than the suction port 152*a*. In other words, even if a circumferential length of the suction-side guide protrusion 1551 is longer than a circumferential length of the suction port 152*a*, a circumferential length of the suction guide groove 1551*a* may be formed shorter than the circumferential length of the suction port 152*a* according to the surrounding condition of the suction-side guide protrusion 1551.

For example, a cross-sectional area of the outer wall 193 may be smaller than or equal to a cross-sectional area of the inner wall 194, and at least a portion of the suction port 152*a* may be eccentric from the suction guide groove 1551*a* toward the first side wall 191 and/or the second sidewall 192. In this case, at least one of the first side wall 191 or the second side wall 192 may be curved according to a shape of a side surface of the suction guide groove 1551*a*. The suction port 152*a* according to this embodiment may be eccentric from the suction guide groove 1551*a* toward the second side wall 192, and the second side wall 192 may extend in a curved shape from the outer wall 191 toward the inner wall 192 such that a distance between the first side wall 191 and the second side wall 192 increases. Accordingly, even if the shape of the non-orbiting scroll 150, that is, the circumferential length of the suction guide groove 1551*a* formed in the suction-side guide protrusion 1551 is shorter than the circumferential length of the suction port 152*a*, the suction guide 190 may accommodate the entire suction port 152*a*.

A lower end of the first side wall 191 and a lower end of the second side wall 192 may be supported by being placed on an upper surface of the suction-side guide protrusion 1551. However, an outer surface of the lower end of the first side wall 191 and an outer surface of the lower end of the second side wall 192 may be supported by being in close contact with an inner surface of the suction guide groove 1551*a*, respectively.

For example, referring to FIG. 4, stepped surfaces (hereinafter, "second stepped surfaces") 1551*c* may be formed in the circumferential direction between upper surfaces of the suction-side guide protrusions 1551 which are located at both sides of the suction guide groove 1551*a* and an upper surface of the circumferential extension portion 1551*b* that connects the suction-side guide protrusions 1551. An outer surface of a lower end of the first side wall 191 and an outer surface of a lower end of the second side wall 192 defining the suction guide 190 may be almost in close contact with the second stepped surfaces in the circumferential direction, respectively. This may prevent generation of a gap between the first side wall 191 and an inner surface of the suction-side guide protrusion 1551 facing it and a gap between the second side wall 192 and an inner surface of the suction-side guide protrusion 1551 facing it, which may suppress the suction refrigerant from moving toward the high/low pressure separation plate 115 without flowing toward the suction guide 190. In addition, as the first side wall 191 is supported by being in close contact with the inner surface of the suction-side guide protrusion 1551, the suction guide 190 may be stably fixed to the non-orbiting scroll 150.

On the other hand, a suction hole 192*b* may be further formed in at least one of the first side wall 191 or the second side wall 192. The suction hole 192*b* may define a passage inlet 190*b* of the suction guide 190 together with the lower wall 196 described hereinafter. In this case, a cross-sectional area of the passage inlet 190*b* may be enlarged. This will be described hereinafter with reference to FIG. 15.

Referring to FIGS. 4, 7, and 8, the outer wall 193 of the suction guide 190 may connect an outer end of the first side wall 191 and an outer end of the second side wall 192. The outer wall 193 may be formed as a flat surface blocked to seal an outer circumferential side of the suction passage 190*a* and may be formed in a blocked curved surface to correspond to the inner circumferential surface of the cylindrical shell 111 or the upper shell 112.

For example, the outer wall 193 may be in close contact with the inner circumferential surface of the cylindrical shell 111 forming the casing 110. In other words, an outer circumferential surface of the outer wall 193 may be curved at a same curvature as the inner circumferential surface of the casing 110 (precisely, the inner circumferential surface of the high/low pressure separator, but, hereinafter, it is defined as the inner circumferential surface of the casing for convenience). Accordingly, the outer circumferential surface of the outer wall 193 may be brought into contact with the inner circumferential surface of the casing 110 to more precisely seal both sides of the suction guide 190 in the axial direction. This may prevent the suction refrigerant suctioned into a lower side of the suction guide 190 through the refrigerant suction pipe 117 from moving toward the high/low pressure separation plate 115 without flowing toward the suction guide 190.

However, in this case, as described above, the suction guide 190 including the outer wall 193 may be formed of a material having a lower thermal conductivity than the non-orbiting scroll 150, for example, a plastic material such as Teflon, such that thermal conduction through the casing 110 may be suppressed. Although not illustrated, the outer wall 193 may alternatively be formed flat. In this case, sealing protrusions (not illustrated) having the same curvature as the inner circumferential surface of the casing 110 may be further formed on both ends of the outer circumferential surface of the outer wall 193. Although not illustrated, when the suction guide 190 including the outer wall 193 is formed of the same metal as the high/low pressure separation plate 115 or a material having a thermal conductivity equivalent thereto, the outer wall 193 may be spaced apart from the inner circumferential surface of the casing 110.

The outer wall 193 may have substantially a same axial height as the first side wall 191 and the second side wall 192, and have substantially a same circumferential length as the upper wall 195 and a circumferential length of the lower wall 196. In other words, the outer wall 193 may have the same surface height as outer surfaces of some walls 191, 192, and 195 defining the outer surface of the suction passage 190*a*. This may facilitate manufacturing and assembly of the suction guide 190.

Referring to FIGS. 5, and 6, the outer wall 194 of the suction guide 190 may connect an inner end of the first side wall 191 and an inner end of the second side wall 192. As described above, the inner wall 194 may be a surface that defines the passage outlet of the suction guide 190 and may be open fully or partially. This embodiment illustrates an example in which the inner wall 194 is fully open.

The inner wall 194 (or the outlet) may have a cross-sectional area that is greater than or equal to a cross-sectional area of the suction port 152*a*. Accordingly, the inner wall 194 may accommodate the entire suction port 152*a*, thereby minimizing flow resistance in the suction passage 190*a*.

Referring to FIGS. 4 to 6, the outer wall 195 of the suction guide 190 may connect an upper end of the first side wall 191, an upper end of the second side wall 192, and an upper end of the outer wall 193. The upper wall 195 may be a blocked flat surface to seal an upper surface of the suction passage 190*a*.

The upper wall 195 may have a same thickness as the other walls 191, 192, 193, 194, and 196. However, the upper wall 195, which is a surface facing the high/low pressure separation plate 115 in the axial direction, may be located closest to the high/low pressure separation plate 115. Accordingly, the upper wall 195 may be thicker than the other walls. This will be described hereinafter with reference to FIGS. 9 and 10.

Referring to FIGS. 5 and 6, the lower wall 196 of the suction guide 190 may be open fully or partially to define the passage inlet 190*b* of the suction guide 190, as described above. It may be advantageous to form the passage inlet 190*b* as wide as possible in terms of securing a suction volume. This embodiment illustrates an example in which the lower wall 196 is almost fully open.

The lower wall 196 may be disposed at a position higher than the refrigerant suction pipe 117, and a center line passing through the lower wall 196 may intersect with, more specifically, be orthogonal to a center line passing through an outlet end 117*a* of the refrigerant suction tube 117.

For example, the center line passing through the outlet end 117*a* of the refrigerant suction pipe 117 may extend in the radial direction, whereas the center line passing through the lower wall 196 may extend in the axial direction. Accordingly, the lower wall 196 may extend orthogonal to the outlet end 117*a* of the refrigerant suction pipe 117 at a position higher than the outlet end 117*a* of the refrigerant suction pipe 117.

Fixing protrusions 191*a* and 192*a* that fix the suction guide 190 to the non-orbiting scroll 150 may further be formed on the outer surfaces of the first and second side walls 191 and 192. For example, first fixing protrusion 191*a* may extend from the outer surface of the first side wall 191, and the second fixing protrusion 192*a* may extend from the outer surface of the second side wall 192.

More specifically, the first fixing protrusion 191*a* may extend in the circumferential direction from an upper end of the first side wall 191, and the second fixing projection 192*a* may extend in an opposite circumferential direction from a lower end of the second side wall 192. Accordingly, the first fixing protrusion 191*a* may be supported in the axial direction by being placed on the first stepped surface 152*b* of the non-orbiting side wall 152 and the second fixing protrusion 192*a* may be supported in the axial direction by being placed on the upper surface of the suction-side guide protrusion 1551.

Although not illustrated, the first fixing protrusion 191*a* and the second fixing protrusion 192*a* may be formed in various ways depending on positions of the first stepped surface 152*b* and the second stepped surface. For example, the first fixing protrusion 191*a* and the second fixing protrusion 192*a* may be formed opposite to the previous embodiment or may be formed at a same height as each other. Alternatively, only one of the first fixing protrusion 191*a* and the second fixing protrusion 192*a* may be provided.

On the other hand, stepped portions (no reference numeral given) may be formed consecutively on an inner surface of the lower end of the first side wall 191, an inner surface of the lower end of the second side wall 192, and an inner surface of the lower end of the outer wall 193 that define the passage inlet 190*b*. This may increase an area of the passage inlet 190*b*, so that refrigerant may more smoothly flow into the suction guide.

Hereinafter, a refrigerant suction process in the scroll compressor provided with the suction guide 190 according to an embodiment will be described.

Referring to FIGS. 2 and 8, the refrigerant suctioned into the low-pressure portion 110*a* of the casing 110 through the refrigerant suction pipe 117 may be roughly separated into an upstream refrigerant and a downstream refrigerant. The upstream refrigerant may be understood as a refrigerant that flows upward with respect to the refrigerant suction pipe 117, and the downstream refrigerant as a refrigerant that flows downward with respect to the refrigerant suction pipe 117.

The upstream refrigerant may flow into the refrigerant passage 190*a* through the passage inlet 190*b* of the suction guide 190, and move along the suction passage 190*a* of the suction guide 190 to be suctioned directly into the compression chamber (suction pressure chamber) V through the passage outlet 190*c* of the suction guide 190 and the suction port 152*a*. Accordingly, the upstream refrigerant may not come in contact with the drive motor 120, and thus, an increase in a dead volume of the refrigerant suctioned into the compression chamber V may be reduced, thereby improving efficiency of the compressor.

The upstream refrigerant may be suppressed from moving toward the high/low pressure separation plate 115 by the suction guide 190. This may suppress the suction refrigerant from being heated by conductive heat by being in contact with the high/low pressure separation plate 115 or radiant heat in a vicinity of the high/low pressure separation plate 115 before being suctioned into the compression chamber V. In this way, the compressor efficiency may be further improved.

On the other hand, the passage inlet 190*b* of the suction guide 190 may be disposed at a position higher than the outlet end 117*a* of the refrigerant suction pipe 117 in the axial direction. Accordingly, a portion of the suction refrigerant suctioned into the low-pressure portion 110*a* through the refrigerant suction pipe 117 may move toward the drive motor 120 while forming the downstream refrigerant, instead of being directly suctioned into the passage inlet 190*b* of the suction guide 190.

The downstream refrigerant may be brought into contact with the drive motor 120 to cool the drive motor 120 while circulating along the low-pressure portion 110*a* of the casing 110, and then flow upward to be suctioned into the compression chamber V through the refrigerant guide 190. Accordingly, the drive motor may be cooled by the downstream refrigerant, which may suppress overheating of the drive motor, thereby expanding an operation range of the compressor.

Hereinafter, description will be given of another embodiment of a suction guide. That is, the previous embodiment illustrates that all of the walls forming the suction passage have the same thickness, but in some cases, some walls may be thicker than other walls.

Figure 9:
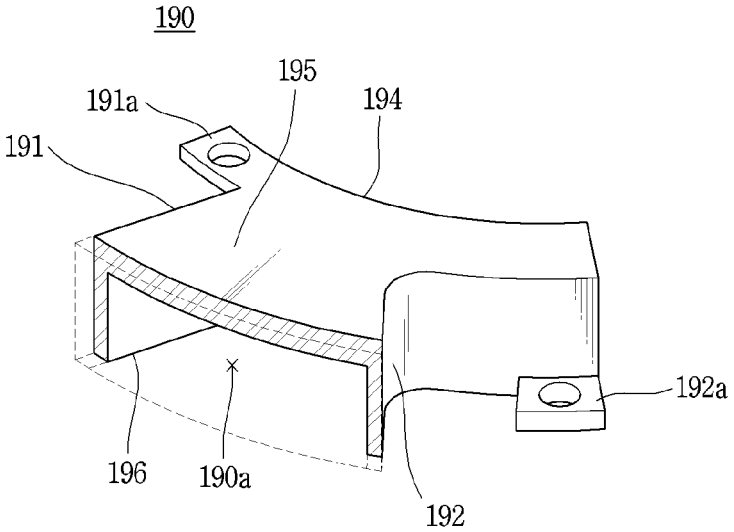
FIG. 9 is a cutout perspective view illustrating another embodiment of the suction guide of FIG. 1.

FIG. 9 is a cutout perspective view illustrating another embodiment of the suction guide of FIG. 1. FIG. 10 is a sectional view illustrating a coupled state of the suction guide of FIG. 9.

Figure 10:
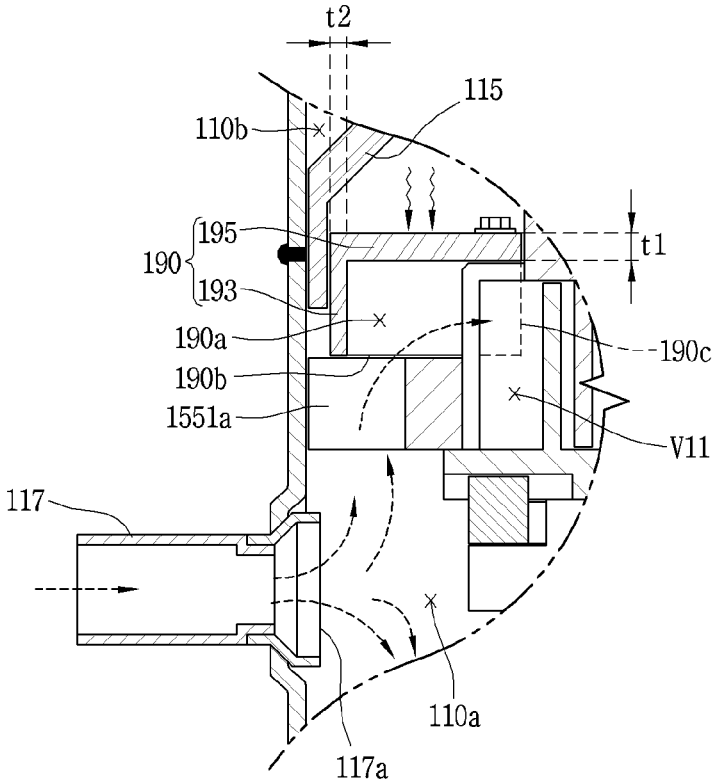
FIG. 10 is a cross-sectional view illustrating a coupled state of the suction guide of FIG. 9.

Referring to FIGS. 9 and 10, a basic shape of the suction guide according to this embodiment and operating effects thereof are similar to those of the previous embodiments. However, the suction guide 190 according to this embodiment may be configured such that some of the walls defining the suction passage 190*a*, more specifically, the upper wall 195 has a thickness t1 thicker than a thickness t2 of the other walls 191, 192, 193, 194, and 196.

For example, a thickness t1 of the upper wall 195 may be approximately twice thicker than a thickness t2 of the first side wall 191 or the second side wall 192. As such, when the thickness t1 of the upper wall 195 is thicker than the thickness t2 of the other walls 191, 192, 193, 194, and 196, radiant heat transferred to the suction guide 190 through the high/low pressure separation plate 115 may be blocked more effectively.

In other words, the upper wall 195, which is a surface facing the high/low pressure separation plate 115 in the axial direction, may be located closest to the high/low pressure separation plate 115, compared to the other walls 191, 192, 193, 194, and 196. Therefore, when the upper wall 195 is thicker than the other walls, radiant heat transmitted through the high/low pressure separation plate 115 may be effectively blocked.

Although not illustrated, a thermal insulation coating layer or a thermal insulation layer may be added to an outer surface (upper surface) or inner surface of the upper wall 195. In addition to the upper wall 195, the first side wall 191 and the second side wall 192 may be thicker than the outer wall 193 or the inner wall 194.

Hereinafter, description will be given of still another embodiment of the suction guide. That is, the previous embodiment illustrates that the outer wall has the same surface height as the outer surfaces of the walls defining the suction passage, but in some cases, the outer wall may protrude from the outer surfaces of the wall portions defining the suction passage.

Figure 11:
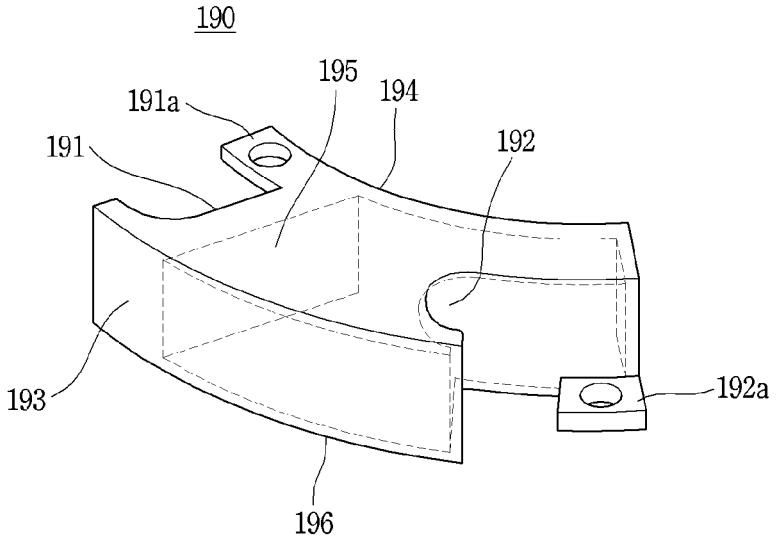
FIG. 11 is a perspective view illustrating still another embodiment of the suction guide of FIG. 1.
Figure 12:
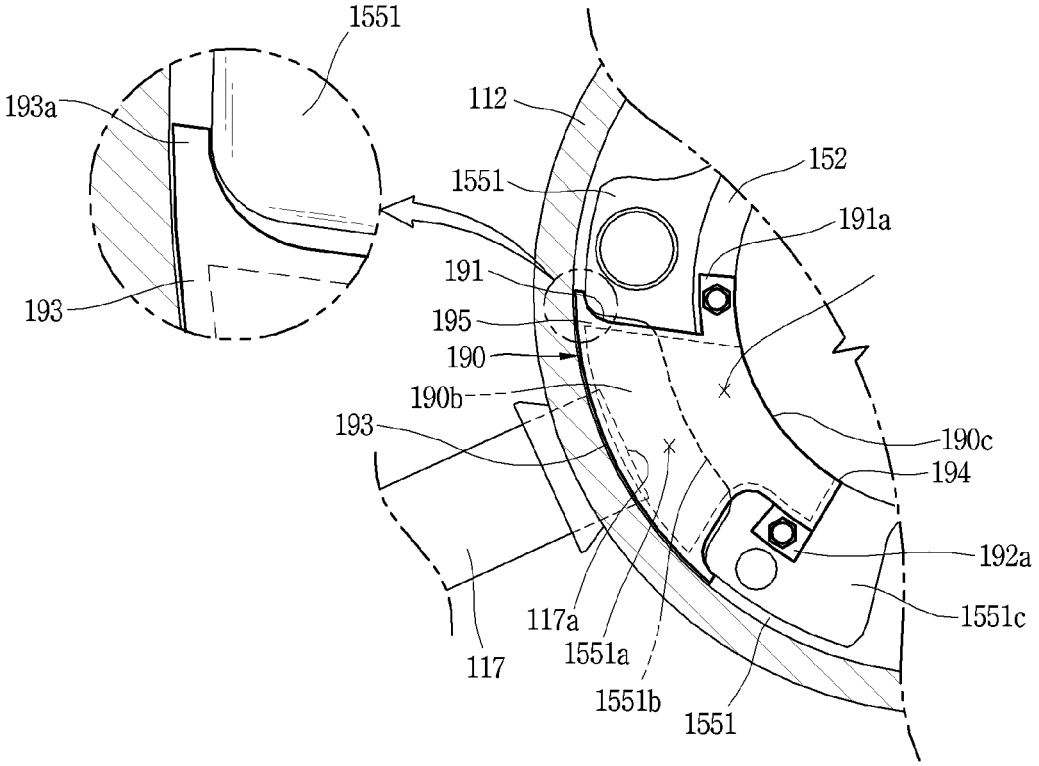
FIG. 12 is a planar view illustrating an assembled state of the suction guide of FIG. 11.

FIG. 11 is a perspective view illustrating still another embodiment of the suction guide of FIG. 1. FIG. 12 is a planar view illustrating an assembled state of the suction guide of FIG. 11.

Referring to FIGS. 11 and 12, the suction guide 190 according to this embodiment may be formed to be substantially similar to the suction guide 190 of FIG. 4. Accordingly, repetitive description of the basic configuration of the suction guide 190 and operating effects thereof has been omitted.

However, in this embodiment, sealing extension portions 193*a* may be provided on both sides of the outer wall 193 in the circumferential direction, respectively. For example, the sealing extension portions 193*a* may protrude more than the outer surface of the first side wall 191 and the outer surface of the second side wall 192 in the circumferential direction.

Outer circumferential surfaces of the sealing extension portions 193*a* may be substantially in surface contact with the inner circumferential surface of the casing 110 facing the outer circumferential surfaces. For example, the outer circumferential surfaces of the sealing extension portions 193*a* may extend to have a same curvature as the outer circumferential surface of the outer wall 193.

Inner circumferential surfaces of the sealing extension portions 193*a* may be formed to correspond to a shape of edges of the suction-side guide protrusions 1551 facing the inner circumferential surface. For example, when the edges of the suction-side guide protrusions 1551 are curved as illustrated in FIG. 12, the inner circumferential surfaces of the sealing extension portions 193*a* may also be curved correspondingly.

When the sealing extension portions 193*a* are formed on both ends of the outer wall 193 in the circumferential direction, a gap between the inner surface of the suction guide groove 1551*a* and the suction guide 190 may be minimized even if the suction guide 190 is accommodated with the gap from the inner surface of the suction guide groove 1551*a*. Accordingly, the suction refrigerant suctioned into the lower side of the suction guide 190 through the refrigerant suction pipe 117 may be further suppressed from flowing toward the high/low pressure separation plate 115, not toward the suction guide 190.

Although not illustrated, the outer wall 193 may extend from the first side wall 191 and the second side wall 192 toward the drive motor 120, namely, downward. In this case, the outer wall 193 may extend by a length such that it does not overlap the outlet end of the refrigerant suction pipe 117 in the axial direction, in terms of flow resistance of the suction refrigerant.

Hereinafter, description will be given of still another embodiment of the suction guide. That is, the previous embodiment illustrates that the lower end of the suction guide is formed flat at the upper side of the refrigerant suction pipe, but in some cases, the lower end of the suction guide may extend to be lower than the refrigerant suction pipe.

Figure 13:
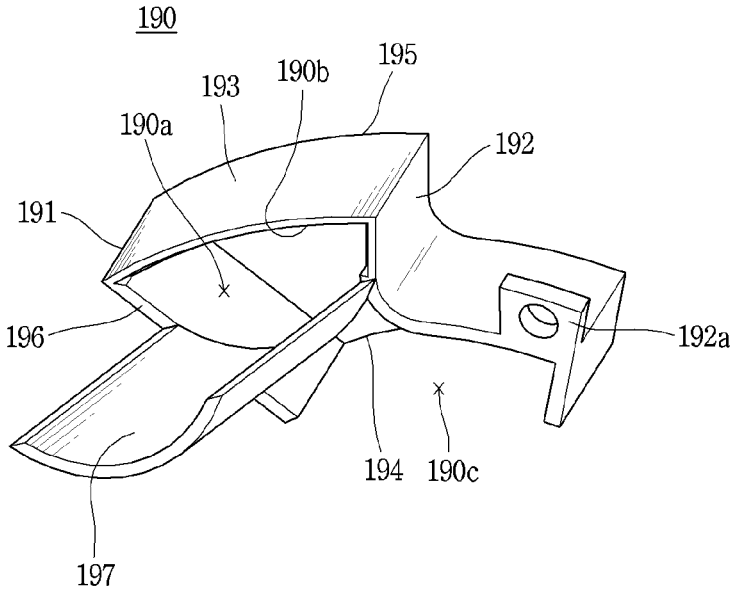
FIG. 13 is a perspective view illustrating still another embodiment of the suction guide of FIG. 1.
Figure 14:
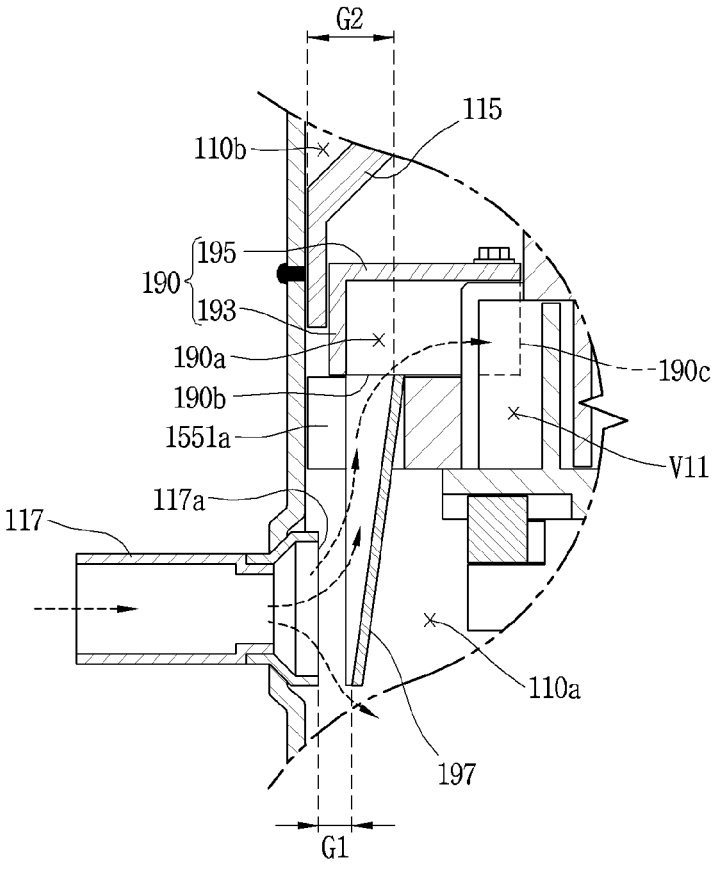
FIG. 14 is a cross-sectional view illustrating an assembled state of the suction guide of FIG. 13.

FIG. 13 is a perspective view illustrating still another embodiment of the suction guide of FIG. 1. FIG. 14 is a sectional view illustrating an assembled state of the suction guide of FIG. 13.

Referring to FIGS. 13 and 14, the suction guide 190 according to this embodiment may be formed to be substantially similar to the suction guide of the previous embodiment. For example, the suction guide 190 may include first side wall 191, second side wall 192, outer wall 193, inner wall 194, upper wall 195, and lower wall 196. Among these walls, the first side wall 191, the second side wall 192, the outer wall 193, and the upper wall 195 may define suction passage 190*a*. Also, the lower wall 196 may define passage inlet 190*b*, which is an inlet of the suction passage 190*a*, and the inner wall 194 may define passage outlet 190*c*, which is an outlet of the suction passage 190*a*.

In the suction guide 190, the lower wall 196 defining the passage inlet 190*b* may be located higher than the outlet end 117*a* of the refrigerant suction pipe 117, and may be disposed to intersect with the refrigerant suction pipe 117. Accordingly, some of the refrigerant suctioned into the low-pressure portion of the casing 110 through the refrigerant suction pipe 117 may be directly suctioned into the compression chamber V through the suction guide 190, while the remaining refrigerant may flow toward the drive motor 120 to cool the drive motor 120 and be suctioned into the suction guide 190. This is the same as the previous embodiment, and thus, repetitive description thereof has been omitted.

However, in this embodiment, a suction extension portion 197 may further be provided to extend from the lower wall 196 toward the drive motor 120 or from the first side wall 191 and the second side wall 192 toward the drive motor 120. This embodiment illustrates an example in which the suction extension portion extends from the lower end of the first side wall 191 and the lower end of the second side wall 192 because the lower wall 196 is fully open.

At least a portion of the suction extension portion 197 may overlap the outlet end 117*a* of the refrigerant suction pipe 117 in the radial direction. In other words, the suction extension portion 197 may extend toward the drive motor 120 so that its lower end may be located lower than the outlet end 117*a* of the refrigerant suction pipe 117. Accordingly, even if the passage inlet 190*b* of the suction guide 190 is disposed higher than the outlet end 117*a* of the refrigerant suction pipe 117, the downstream refrigerant may partially be guided to the compression chamber by the suction extension portion 197. This may appropriately reduce heating of the downstream refrigerant due to contact with the drive motor 120, thereby enhancing efficiency of the compressor.

The suction extension portion 197 according to this embodiment may be formed in parallel in the axial direction. However, the suction extension portion 197 may be formed so that its upper end is located farther from the inner circumferential surface of the casing 110 than its lower end.

For example, when a first interval G1 is from a lower end of the suction extension portion 197 facing the drive motor 120 to the inner circumferential surface of the casing 110 and a second interval G2 is from an upper end of the suction extension portion 197 in contact with the passage inlet 190*b* to the inner circumferential surface of the casing 110, the first interval G1 may be less than the second interval G2. Accordingly, the suction extension portion 197 may get farther from the outlet end 117*a* of the refrigerant suction pipe 117 from the lower end to the upper end, so that the refrigerant suctioned into the low-pressure portion 110*a* may flow more smoothly toward the suction guide 190.

In addition, the suction extension portion 197 according to this embodiment may be formed flat, but may alternatively have a cross-section in an arcuate shape or in a wedge shape to surround the outlet end 117*a* of the refrigerant suction pipe 117. When the suction extension portion 197 is formed to have the cross-section in the arcuate shape or the wedge shape, the refrigerant suctioned into the low-pressure portion 110*a* through the refrigerant suction pipe 117 may be gathered by the inner circumferential surface of the suction extension portion 197 facing the refrigerant suction pipe 117, so as to be introduced more smoothly into the suction guide 190.

Hereinafter, description will be given of still another embodiment of the suction guide. That is, the previous embodiment illustrates that the first side wall and the second side wall defining the side surfaces of the suction guide are formed in a closed shape, but in some cases, a suction hole may be formed through at least one of the first side wall or the second side wall.

Figure 15:
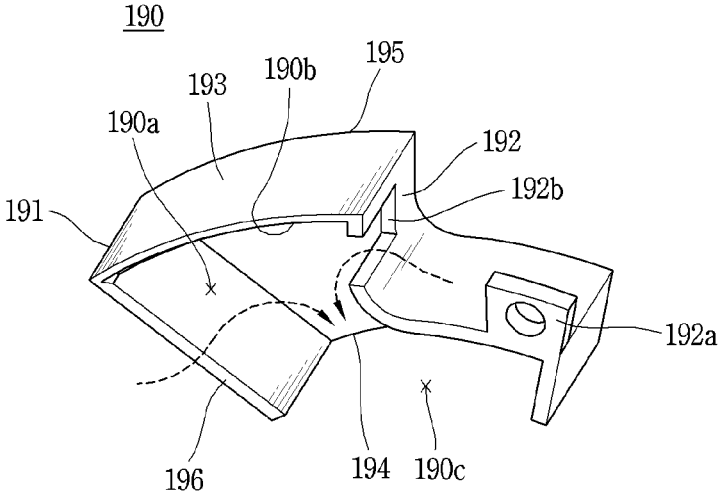
FIG. 15 is a perspective view illustrating still another embodiment of the suction guide of FIG. 1.

FIG. 15 is a perspective view illustrating still another embodiment of the suction guide of FIG. 1. Referring to FIG. 15, as the suction guide 190 according to this embodiment is almost similar to the previous embodiments as a whole, repetitive description has been omitted.

However, in this embodiment, a suction hole 192*b* may be further formed at the second side wall 192. The suction hole 192*b* may define the passage inlet 190*b* of the suction guide 190 together with the lower wall 196 described hereinafter. The suction hole 192*b* may be formed through a middle of the second side wall 192 or may extend from the lower wall 196.

The suction hole 192*b* may be formed as large as possible within a range not interfering with the circumferential extension portion 1551*b*, which may be advantageous in terms of enlarging a suction area while securing support strength of the suction guide 190.

When the suction hole 192*b* defining the passage inlet 190*b* is formed through the first side wall 191 and/or the second side wall 192, the cross-sectional area of the entire passage inlet 190*b* may be increased. Accordingly, the suction refrigerant may flow more smoothly into the suction guide 190 so as to increase volumetric efficiency.

The previous embodiments illustrate that the outer wall 193 of the suction guide 190 is spaced apart from the casing 110, but in some cases, the outer wall 193 of the suction guide 190 may be fixed to the inner circumferential surface of the casing 110. For example, a guide bracket (not illustrated) may be fixed to the inner circumferential surface of the casing 110 and the suction guide 190 may be coupled to the guide bracket. The guide bracket may be located between the refrigerant suction pipe 117 and the high/low pressure separation plate 115, and the suction guide 190 may be formed similarly to those in the previous embodiments. However, when the suction guide 190 is made of a metal material, the suction guide 190 may be, for example, directly welded to the casing 110 to be fixed.

In the structure in which the outer wall 193 of the suction guide 190 is fixed to the casing 110, the inner wall 194 of the suction guide 190 may be spaced apart from the non-orbiting scroll 150, and may also be coupled to the non-orbiting scroll 150. Accordingly, structure in which the outer wall 193 of the suction guide 190 is fixed to the casing 110 may be more suitable in a structure in which the non-orbiting scroll 150 is fixed to the casing 110. Even in this case, as the suction guide 190 has the basic configuration and operating effects similar to those of the previous embodiments, repetitive description thereof has been omitted.

In a scroll compressor according to this embodiment, the suction guide protrusion 156 and a suction guide 290 may be disposed at an inlet of the compression chamber, namely, between the refrigerant suction pipe 117 and the high/low pressure separation plate 115, to prevent the suction refrigerant from being heated directly or indirectly by the high/low pressure separation plate 115. With this configuration, an increase in the specific volume of the refrigerant suctioned into the compression chamber may be suppressed, and thus, an amount of refrigerant suctioned into the compression chamber may increase, thereby improving efficiency of the compressor.

In addition, in the scroll compressor according to this embodiment, the suction guide protrusion 156 and the suction guide 290 may be provided to guide a portion of the suction refrigerant to flow toward the drive motor 120. Accordingly, some of the suction refrigerant may be guided toward the drive motor 120 so as to prevent overheating the drive motor 120, thereby further improving efficiency of the compressor and simultaneously preventing a reduction of an operation-allowed region (operation range) due to the overheat of the drive motor 120.

Figure 16:
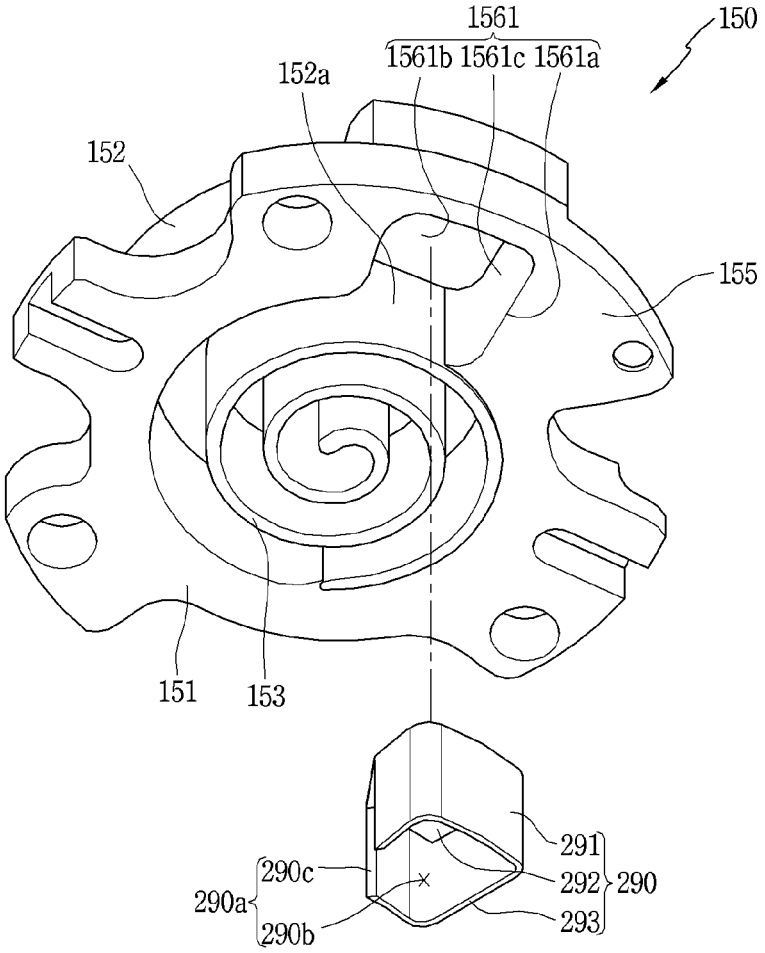
FIG. 16 is an exploded perspective view illustrating another embodiment of the suction guide of FIG. 1.
Figure 17:
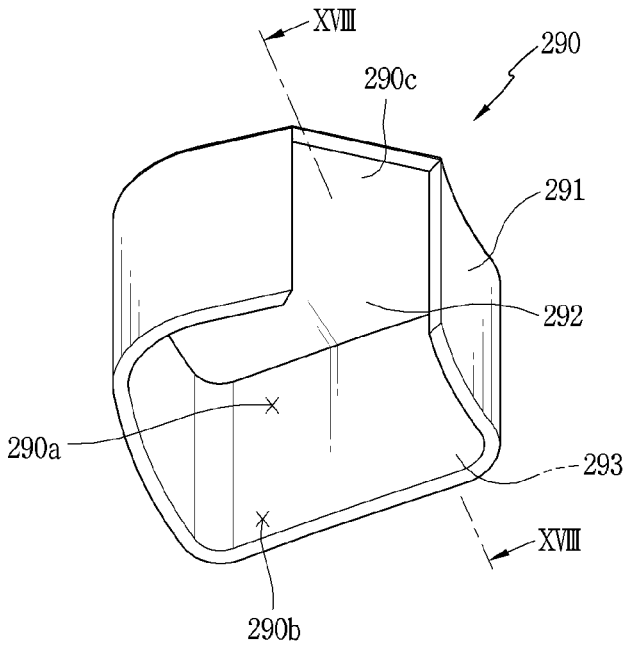
FIG. 17 is a perspective view illustrating the suction guide of FIG. 16.
Figure 18:
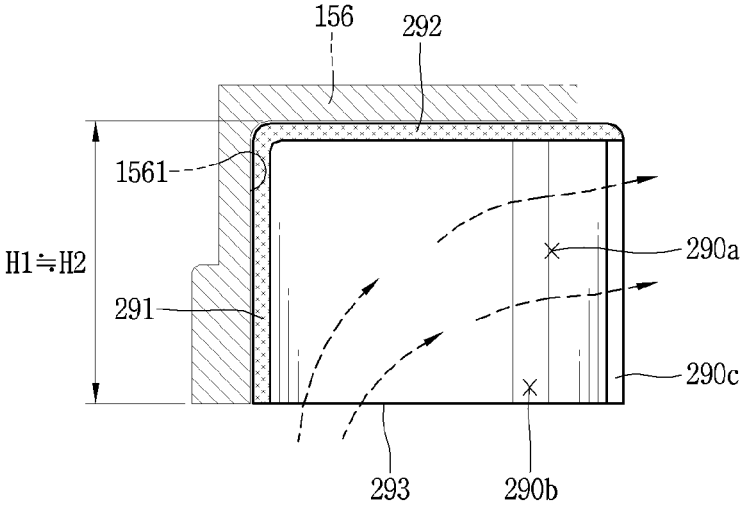
FIG. 18 is a cross-sectional view, taken along line "XVIII-XVIII" of FIG. 17.
Figure 19:
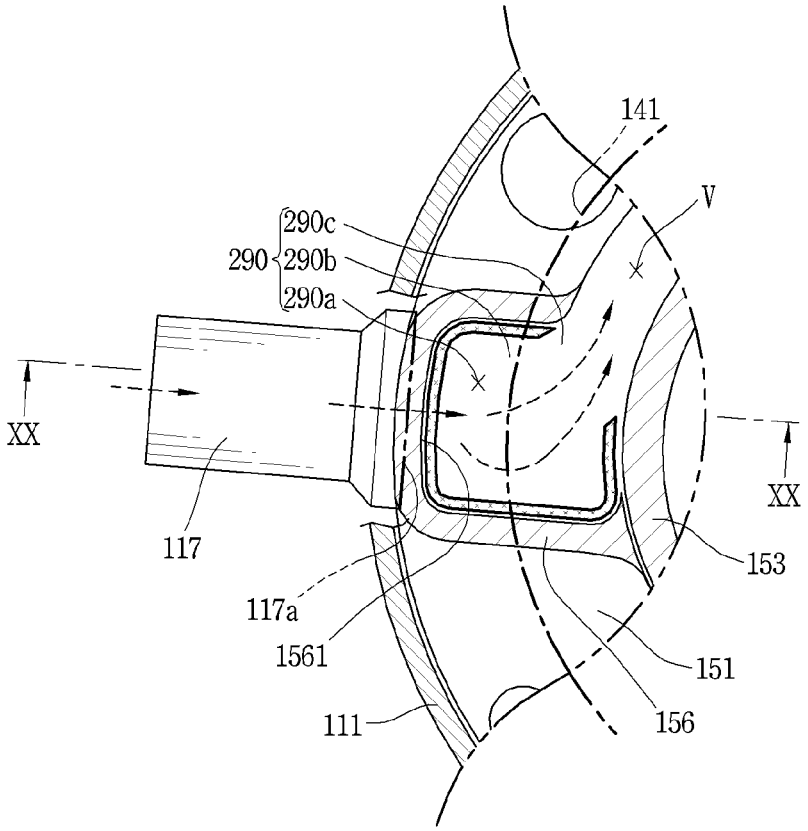
FIG. 19 is a horizontal sectional view illustrating an assembled state of the suction guide of FIG. 17.
Figure 20:
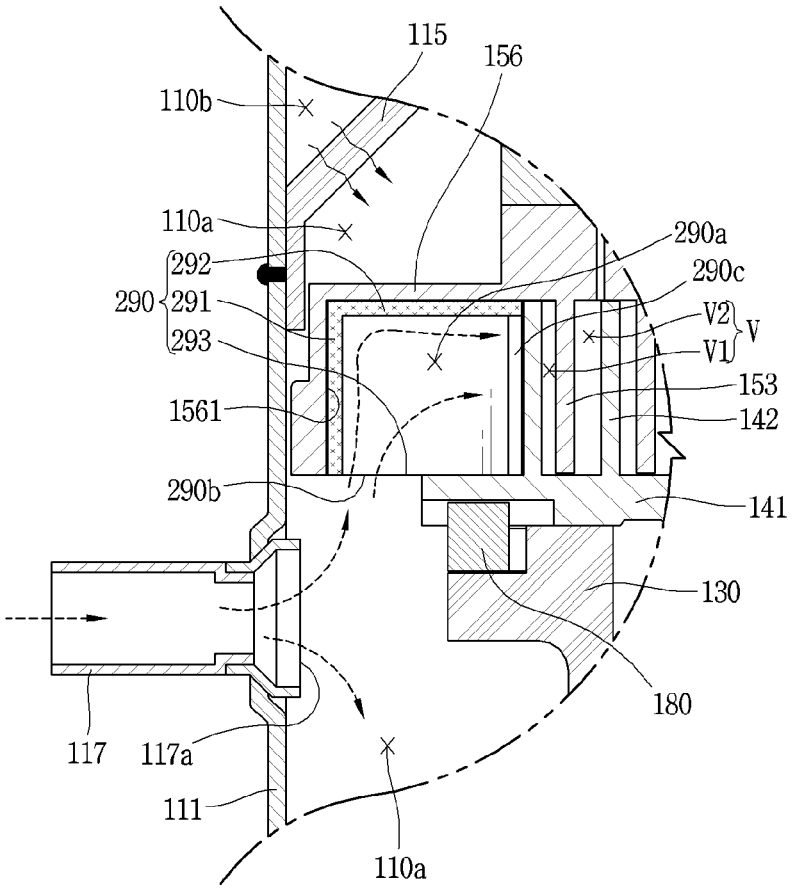
FIG. 20 is cross-sectional view, taken along line "XX-XX" of FIG. 19.

FIG. 16 is an exploded perspective view illustrating another embodiment of the suction guide of FIG. 1. FIG. 17 is a perspective view illustrating the suction guide of FIG. 16. FIG. 18 is a cross-sectional view, taken along line "XVIII-XVIII" of FIG. 17. FIG. 19 is a horizontal sectional view illustrating an assembled state of the suction guide of FIG. 17, and FIG. 20 is cross-sectional view, taken along the line "XX-XX" of FIG. 19.

Referring to FIGS. 16 to 20, the guide accommodating portion 1561 may be recessed into the suction guide protrusion 156 according to this embodiment, and the suction guide 290 made of an insulating material may be inserted into the guide accommodating portion 1561. Accordingly, the refrigerant which is suctioned into the low-pressure portion 110*a* through the refrigerant suction pipe 117 may be prevented from being in contact with the high/low pressure separation plate 115, and also prevent refrigerant suctioned into the compression chamber V through the suction guide 290 from being heated by the non-orbiting scroll 150.

More specifically, the suction guide protrusion 156 according to this embodiment, as described above, may surround the circumference of the suction port 152*a* and simultaneously protrude in the radial direction toward the inner circumferential surface of the casing 110. Accordingly, the suction guide protrusion 156 may be located between the outlet end 117*a* of the refrigerant suction pipe 117 and the high/low pressure separation plate 115, so as to prevent the refrigerant suctioned through the refrigerant suction pipe 117 from moving toward the high/low pressure separation plate 115.

The suction guide protrusion 156 may be provided with the guide accommodating portion 1561 formed therein. In other words, the suction guide protrusion 156 may be recessed by a predetermined depth from a lower surface (unsigned) thereof facing the drive motor 120 to an upper surface (unsigned) facing the high/low pressure separation plate 115, thereby forming the guide accommodating portion 1561. Accordingly, the inner circumferential surface of the suction guide protrusion 156 may define the guide accommodating portion 1561.

A lower surface 1561*a* of the guide accommodating portion 1561 may be open toward the outlet end 117*a* of the refrigerant suction pipe 117, while an upper surface 1561*b* of the guide accommodating portion 1561 may be closed with respect to the high/low pressure separation plate 115. In addition, a side wall surface 1561*c* may connect the lower surface 1561*a* and the upper surface 1561*b* of the guide accommodating portion 1561. A portion of the side wall surface 1561*c* may be closed together with the upper surface 1561*b* along the circumferential direction, while the remaining portion may be open together with the lower surface 1561*a*. In other words, an outer circumferential side of the side wall surface 1561*c* of the guide accommodating portion 1561 may be closed along the circumference but an inner circumferential side thereof may be open toward the suction port 152*a*. Accordingly, the guide accommodating portion 1561 may be formed substantially in a hexahedral hollow box shape as a whole. A portion of the lower surface 1561*a* and a portion of the side wall portion 1561*c* may be open so as to define a suction passage 290*a* of the suction guide 290 to be described hereinafter.

Referring to FIGS. 16 to 18, the suction guide 290 according to this embodiment may be formed to be substantially the same as an inner shape of the suction guide protrusion 156, that is, a shape of the guide accommodating portion 1561. In other words, the suction guide 290 may be formed substantially in a hollow hexahedral shape like the guide accommodating portion 1561. Accordingly, the outer circumferential surface of the suction guide 290 may be in close contact or almost in contact with the inner circumferential surface of the guide accommodating portion 1561 so as to be integrally coupled.

The non-orbiting scroll 150 including the suction guide protrusion 156 may be formed of, for example, cast iron, while the suction guide 290 may be formed of, for example, insulating plastic, such as Teflon or an insulating metal. However, without being limited to the insulating material, the suction guide 290 may be formed of any material which has low thermal conductivity, for example, a material having a lower thermal conductivity than the material of the non-orbiting scroll. However, in order to reduce a specific volume of suctioned refrigerant as much as possible, it may be advantageous that the suction guide 290 is formed of an insulating material.

More specifically, the suction guide 290 according to this embodiment may include a side wall portion or side wall 291, an upper wall portion or upper wall 292, and a lower wall portion or lower wall 293. The side wall 291 may extend in the radial direction from both circumferential sides of the suction port 152*a* to accommodate the suction port 152*a*. The upper wall 292 may define one axial side surface that is an upper surface of the side wall 291 facing the high/low pressure separation plate 115, and the lower wall 293 may define another axial side surface that is a lower surface of the side wall 291 facing the drive motor. In other words, the suction guide 290 may be formed substantially in a hexahedral hollow box shape by the side wall 291, the upper wall 292, and the lower wall 293.

However, the upper wall 292 may cover one axial side surface of the side wall 291 to form a space defining the suction passage 290*a* together with the side wall 291. The lower wall 293 may be at least partially or fully open to define passage inlet 290*b* of the suction passage 290*a* and the side wall 291 may be partially open in a slit shape toward the suction port 152*a* to define passage outlet 290*c* of the suction passage 290*a*. Accordingly, the suction passage 290*a* through which the refrigerant suctioned into the low-pressure portion 110*a* through the refrigerant suction pipe 117 is guided to the compression chamber V may be defined inside the suction guide 290. The passage inlet 290*b* may be formed through the lower surface of the suction guide 290 and the passage outlet 290*c* may be formed through the side surface.

The lower wall 293 and the side wall 291 may be partially connected, and thereby the passage inlet 290*b* defined by the lower wall 293 may be connected to the passage outlet 290*c* defined by the portion of the side wall 291. Accordingly, both side walls 291 defining the passage outlet 290*c* therebetween may have elasticity, such that the suction guide 290 may be elastically inserted into the guide accommodating portion 1561 to be firmly coupled thereto.

Referring to FIG. 18, the inner circumferential surface of the side wall 291 and the inner circumferential surface of the upper wall 292 may be connected to be substantially orthogonal to each other. This may result in securing a largest volume of the suction passage 290*a* defined by the inner circumferential surface of the side wall 291 and the inner circumferential surface of the upper wall 292 based on a same side wall height H1.

The suction guide 290 may have substantially a same thickness as a whole. For example, the side wall 291 and the upper wall 292 may have a same thickness so as to constitute a single body. This may facilitate the manufacturing of the suction guide 290.

Although not illustrated, a portion of the suction guide 290 may be post-assembled. For example, only a portion of the lower wall 293 may be open and a remaining portion of the lower wall 293 may partially cover another axial side surface of the side wall 291. In this case, the side wall 291 and the upper wall 292 may be formed as a single body, while the remaining portion of the lower wall 293 may be bonded on the other axial side surface of the side wall 291.

The suction guide 290 may be fully inserted into the guide accommodating portion 1561. For example, as illustrated in FIG. 18, the side wall height H1 of the suction guide 290 may be lower than or equal to an axial height H2 of the guide accommodating portion 1561. Accordingly, the outer circumferential surface of the suction guide 290 may be in contact with the inner circumferential surface of the guide accommodating portion 1561 in a state in which the suction guide 290 is inserted without being exposed from the suction guide protrusion 156. This may suppress the suction guide 290 from interfering with the orbiting motion of the orbiting scroll 140, thereby enhancing reliability of the compressor.

Referring to FIGS. 19 and 20, the suction guide 290 may overlap the orbiting scroll 140 when projected in the axial direction. For example, the suction guide 290 may be formed such that a portion of the side wall 291, more precisely, the side wall 291 in a vicinity of the passage outlet 290*c* located adjacent to the suction port 152*a* is located in an orbiting range of the orbiting end plate 141. Accordingly, when the side wall height H1 of the suction guide 290 is the same as an axial height H2 of the guide accommodating portion 1561, a lower surface of the side wall 291 defining the passage inlet 290*b* of the suction guide 290 may be slidably in contact with the upper surface of the orbiting end plate 141, so that the suction guide 290 may be axially supported by the orbiting end plate 141.

As described above, the refrigerant suction process when the suction guide is provided at the non-orbiting scroll may be as follows.

That is, the refrigerant suctioned into the low-pressure portion 110*a* of the casing 110 through the refrigerant suction pipe 117 may be roughly separated into an upstream refrigerant and a downstream refrigerant. The upstream refrigerant may be understood as a refrigerant that flows upward with respect to the refrigerant suction pipe 117, and the downstream refrigerant as a refrigerant that flows downward with respect to the refrigerant suction pipe 117.

The upstream refrigerant may be introduced into the suction passage 290*a* through the passage inlet 290*b* of the suction passage 290*a* defining the inlet of the suction guide 290, move along the suction passage 290*a*, and then flow toward the suction port 152*a* of the non-orbiting scroll through the passage outlet 290*c* of the suction passage 290*a* defining the outlet of the suction guide 290, thereby being suctioned directly suctioned into the compression chamber (suction pressure chamber) V. Accordingly, the upstream refrigerant may not come in contact with the drive motor 120, and thus, an increase in specific volume of the refrigerant suctioned into the compression chamber V may be reduced, thereby improving efficiency of the compressor.

At this time, the upstream refrigerant may move toward the high/low pressure separation plate 115, but may be blocked by the suction guide 290 located between the high/low pressure separation plate 115 and the outlet end 117*a* of the refrigerant suction pipe 117. The upstream refrigerant may thusly be prevented from being in contact with the high/low pressure separation plate 115. This may suppress the suction refrigerant from being heated by conductive heat due to contact with the high/low pressure separation plate 115 or radiant heat in a vicinity of the high/low pressure separation plate 115 before being suctioned into the compression chamber V. In this way, volumetric efficiency of the suction refrigerant may be improved, and thus, performance of the compressor may be further enhanced.

On the other hand, as described above, as the passage inlet 290*b* of the suction guide 290 is disposed higher than the outlet end 117*a* of the refrigerant suction pipe 117 in the axial direction, some of the suction refrigerant suctioned into the low-pressure portion 110*a* through the refrigerant suction pipe 117 may not flow toward the compression chamber V, but may form the downstream refrigerant to flow toward the drive motor 120. The downstream refrigerant may be brought into contact with the drive motor 120 to cool the drive motor 120 while circulating along the low-pressure portion 110*a*, and then flow upward to be suctioned into the compression chamber V through the refrigerant guide 290. Accordingly, the drive motor 120 may can be cooled by the downstream refrigerant, which may suppress overheating of the drive motor 120, thereby expanding an operation range of the compressor.

Hereinafter, description will be given of another embodiment of a suction guide. That is, the previous embodiment illustrates that the suction guide is shrink-fitted to the guide accommodating portion or press-fitted using elasticity of a material, but in some cases, a coupling portion for forcibly coupling the suction guide and the guide accommodating portion may be further provided.

Figure 21A:
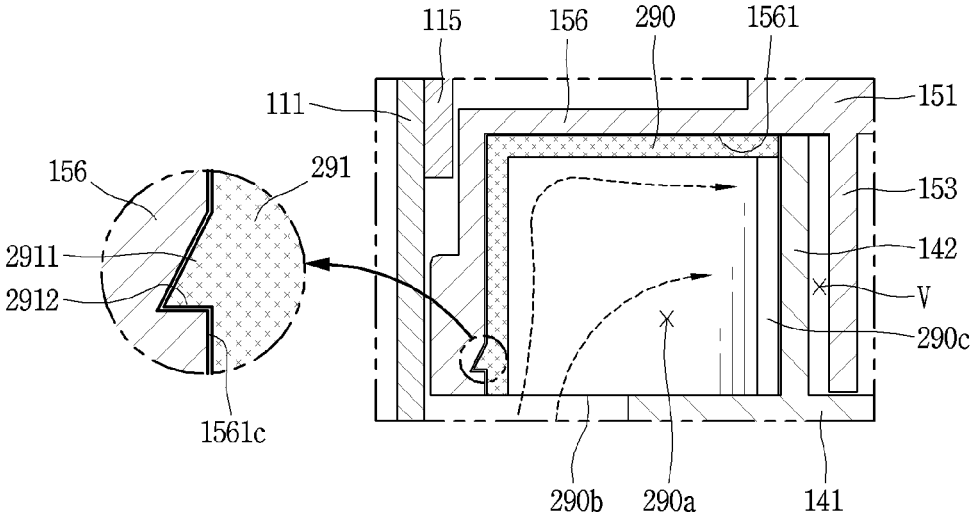
FIGS. 21A and 21B are views illustrating different embodiments for a coupling structure of the suction guide in FIG. 17.
Figure 21B:
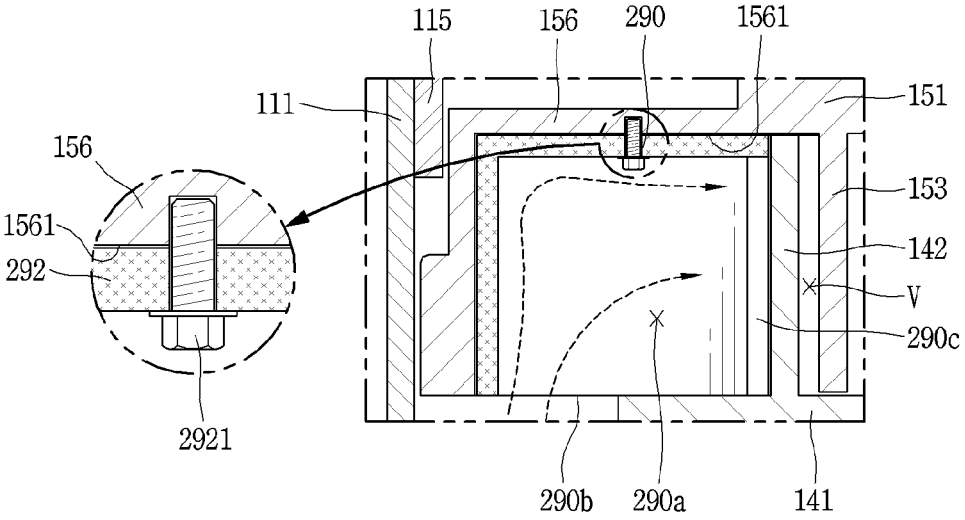

FIGS. 21A and 21B are views illustrating different embodiments for a coupling structure of a suction guide in FIG. 16. Referring to FIG. 21A, the basic configuration of the guide accommodating portion 1561 and the suction guide 290 according to this embodiment and operating effects thereof are almost the same as those of the previous embodiment. Therefore, repetitive description thereof has been omitted.

However, in this embodiment, coupling portions may be formed at an outer circumferential surface of the suction guide 290 and an inner circumferential surface of the guide accommodating portion 1561 facing it, respectively, to be engaged with each other. The coupling portions may include a hook protrusion 2911 and a hook groove 2912. Hereinafter, description will be mainly given of an example in which the hook protrusion 2911 is formed on the outer circumferential surface of the suction guide 290 and the hook groove 2912 is formed in the inner circumferential surface of the guide accommodating portion 1561.

At least one hook projection 2911 may be formed on the outer circumferential surface of the side wall 291 of the suction guide 290, and the hook groove 2912 may be formed in the outer circumferential surface of the guide accommodating portion 1561 that faces the inner circumferential surface of the side wall 291 of the suction guide 290 so as to correspond to the hook protrusion 2911. The hook protrusion 2911 and the hook groove 2912 may be formed in a wedge cross-sectional shape or may be formed in a hemispherical cross-sectional shape. This may be determined depending on a material of the suction guide 290. For example, when the suction guide 290 is formed of a relatively hard material, the hemispherical cross-sectional shape may be utilized. On the other hand, when the suction guide 290 is formed of a soft material, the wedge cross-sectional shape may be utilized.

The hook protrusion 2911 and the hook groove 2912 may be located at the lower wall 293, for example, at positions lower than a middle height of the side wall 291. Accordingly, the hook protrusion 2911 may be easily assembled with the hook groove 2912 even if the suction guide 290 is formed of a material having relatively high rigidity, such as an insulating metal. In addition, in a process of inserting the hook protrusion 2911 into the hook groove 2912, wear of the hook protrusion 2911 on the side wall surface 1561*c* of the guide accommodating portion 1561 may be minimized, thereby firmly maintaining an assembled state between the hook protrusion 2911 and the hook groove 2912, that is, a coupled state of the suction guide 290.

When the suction guide 290 is coupled to the guide accommodating portion 1561 of the suction guide protrusion 156 using the hook protrusion 2911 and the hook groove 2912, a coupling force of the suction guide 290 with respect to the suction guide protrusion 156 may be increased. This may prevent in advance an obstacle due to the suction guide 290 when assembling the compressor.

In addition, in the vertical scroll compressor as in this embodiment, as the guide accommodating portion 1561 of the suction guide protrusion 156 is open downward, the suction guide 290 may be separated from the guide accommodating portion 1561 depending on an operating state. Then, the suction guide 290 may come into contact with and rub against the orbiting scroll 140 or may interfere with the orbiting motion of the orbiting scroll 140.

However, when the suction guide 290 is hooked to the suction guide protrusion 156 as in this embodiment, the suction guide 290 may be stably fixed to the suction guide protrusion 156 so as to be physically prevented from being separated from the guide accommodating portion 1561 of the suction guide protrusion 156. On the other hand, as illustrated in FIG. 21B, the suction guide 290 according to this embodiment may be coupled to the suction guide protrusion 156 by a fastening member. For example, the suction guide 290 may be inserted into the guide accommodating portion 1561 of the suction guide protrusion 156, and a portion between the side wall 291 of the suction guide 290 and the upper surface of the guide accommodating portion 1561 may be coupled using a fastening screw 2921.

Even in this case, the detailed shape of the suction guide 290 or the operating effect thereof is almost the same as that of the previous embodiment of FIG. 8A, so repetitive description thereof has been omitted. Although not illustrated, the fastening member and a fastened position may variously change.

Hereinafter, description will be given of still another embodiment of the suction guide. That is, the previous embodiments illustrate that the side wall and the upper wall are substantially orthogonal to each other, but in some cases, a portion between the side wall and the upper wall may be inclined by a predetermined angle or curved.

Figure 22:
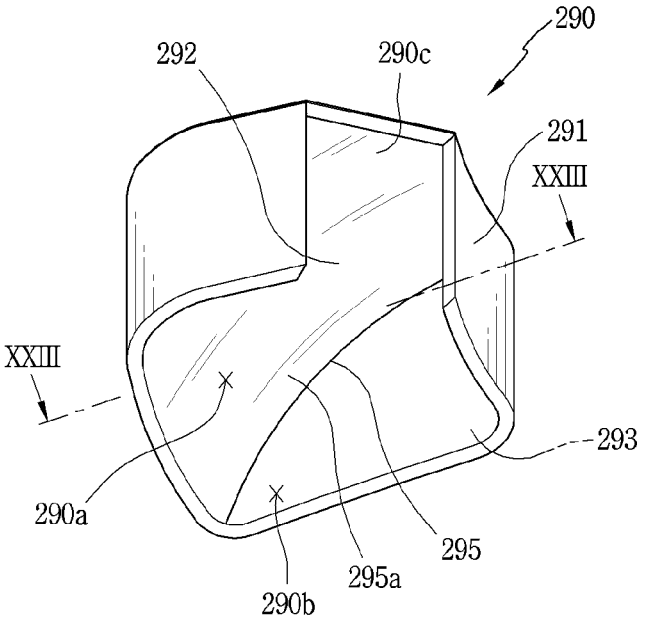
FIG. 22 is a perspective view illustrating another embodiment of the suction guide of FIG. 16.
Figure 23:
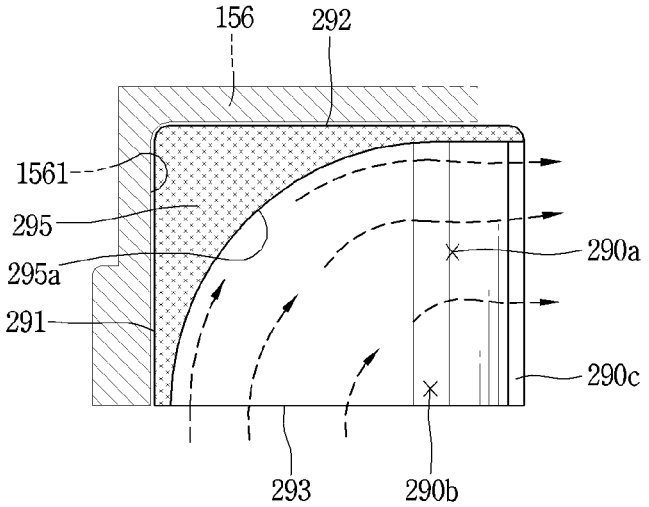
FIG. 23 is a cross-sectional view, taken along line "XXIII-XXIII" of FIG. 22.

FIG. 22 is a perspective view illustrating another embodiment of the suction guide of FIG. 16. FIG. 23 is a cross-sectional view, taken along line "XXIII-XXIII" of FIG. 22, and FIG. 24 is a longitudinal sectional view illustrating an assembled state of the suction guide of FIG. 22.

Figure 24:
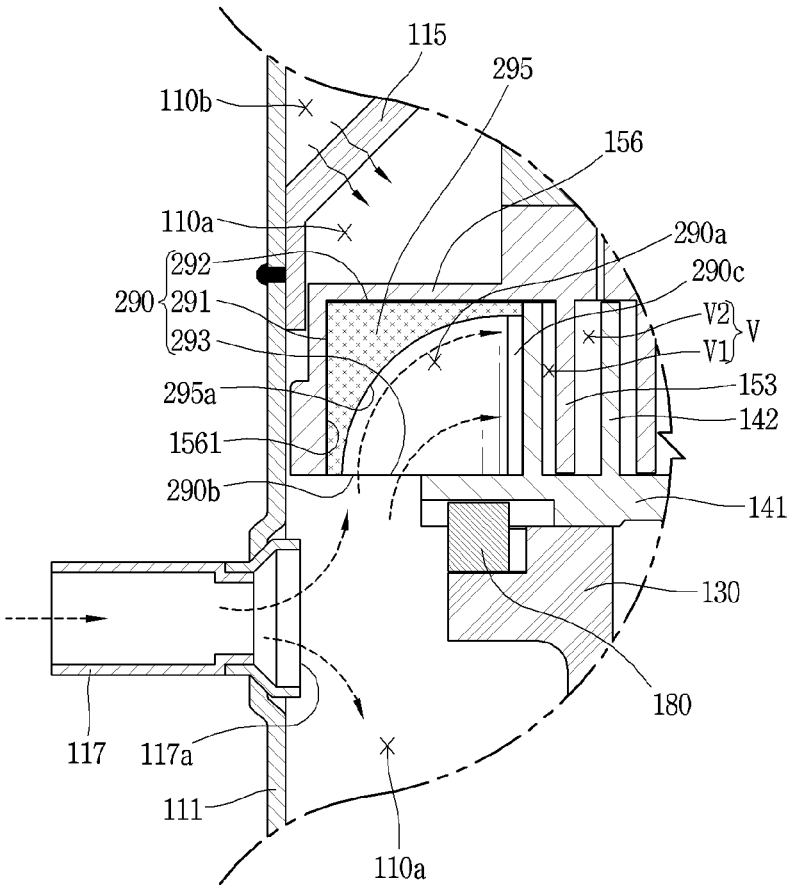
FIG. 24 is a longitudinal sectional view illustrating an assembled state of the suction guide of FIG. 22.

Referring to FIGS. 22 to 24, the basic configuration of the suction guide 290 including the guide accommodating portion 1561 according to this embodiment and operating effects thereof are almost the same as those of the previous embodiments. Therefore, repetitive description of the suction guide 290 including the guide accommodating portion 1561 has been omitted.

In addition, the suction guide 290 according to this embodiment may be, for example, press-fitted, hooked, or screwed to the guide accommodating portion 1561. However, in this embodiment, a first guide portion or guide 295 may be formed between the inner circumferential surface of the side wall 291 and the lower surface of the upper wall 292. For example, the first guide 295 may protrude by a preset or predetermined height from an inner edge where the inner circumferential surface of the side wall 291 and the lower surface of the upper wall 292 meet each other.

In other words, the first guide 295 may be understood as a kind of built-up portion disposed on the inner edge where the inner circumferential surface of the side wall 291 and the lower surface of the upper wall 292 meet each other. The first guide 295 may be formed at an inner edge facing the passage outlet 290*c* of the suction passage 290*a*, among inner edges. The inner edge may be located far away from the passage inlet 290*b* and the passage outlet 290*c*, and thus, its role as the suction passage 290*a* may be relatively not so great. Accordingly, a reduction in volume of the suction passage 290*a* may be minimized even while forming the built-up portion in the suction passage 290*a*.

First guide 295 may connect the inner circumferential surface of the side wall 291 and the lower surface of the upper wall 292 to define a first guide surface 295*a* which corresponds to the inner circumferential surface of the suction passage 290*a*. The first guide surface 295*a* may be curved or inclined from the passage inlet 290*b* toward the passage outlet 290*c*. In other words, the first guide surface 295*a* may be curved or inclined to connect the lower end of the side wall 291 and the lower surface of the upper wall 292. This embodiment illustrates an example in which the first guide surface 295*a* is recessed toward the inner edge to be curved at a preset or predetermined curvature.

When the first guide 295 is formed at the inner edge forming the suction passage 290*a*, a depth of an inner surface of the suction passage 290*a* may become shallow at the inner edge. Then, the suction refrigerant may be refracted by the first guide 295, which may result in preventing an occurrence of vortex of the refrigerant near the inner edge. Accordingly, the suction refrigerant may be rapidly suctioned into the compression chamber without a delay in the suction passage, thereby improving volumetric efficiency of the compression chamber.

In addition, as the first guide surface 295*a* of the first guide 295 defining the inner surface of the suction passage 290*a* is curved or inclined, an angle of the inner surface of the suction passage 290*a* defined by the inner circumferential surface of the side wall 291, the first guide surface 295*a*, and the inner circumferential surface of the upper wall 292 may be an obtuse angle. Accordingly, a flow angle of the refrigerant may become gentle, and thus, flow resistance of the refrigerant may decrease. This may allow the refrigerant to move toward the compression chamber more quickly, thereby further improving volumetric efficiency of the compression chamber.

Although not illustrated, the first guide surface 295*a* may be a three-dimensional surface. For example, the first guide surface 295*a* may be formed to be concentrated in a substantially funnel shape toward the passage outlet 290*c* of the suction passage 290*a*. In this case, an eddy current of the refrigerant may be more effectively prevented and a flow rate of the refrigerant may increase.

Hereinafter, description will be given of still another embodiment of the suction guide. That is, the previous embodiments illustrate that the lower end of the suction guide is inserted so as not to be exposed to the outside of the guide accommodating portion, but in some cases, a portion of the suction guide may be exposed to the outside of the guide accommodating portion.

Figure 25:
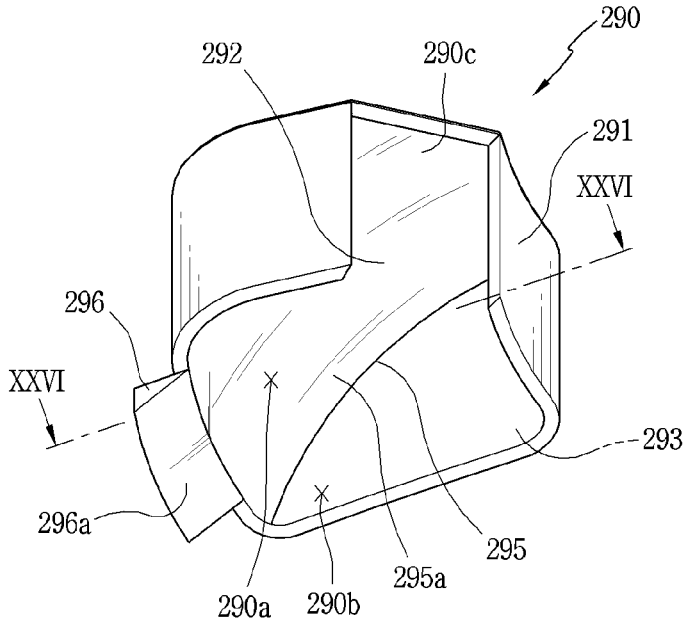
FIG. 25 is a perspective view illustrating another embodiment of the suction guide of FIG. 16.
Figure 26:
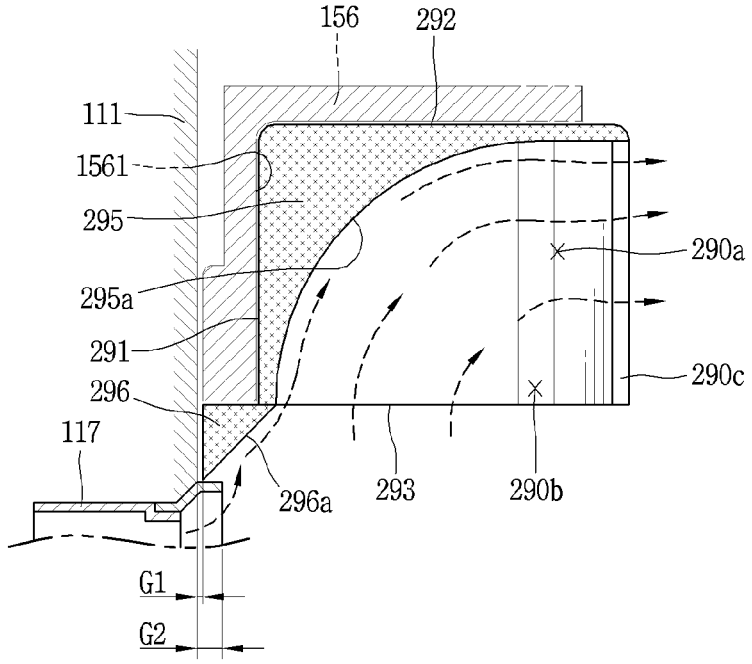
FIG. 26 is a cross-sectional view, taken along line "XXVI-XXVI" of FIG. 25.

FIG. 25 is a perspective view illustrating another embodiment of the suction guide of FIG. 16. FIG. 26 is a cross-sectional view, taken along line "XXV-XXV" of FIG. 25, and FIG. 27 is a longitudinal sectional view illustrating an assembled state of the suction guide of FIG. 25.

Figure 27:
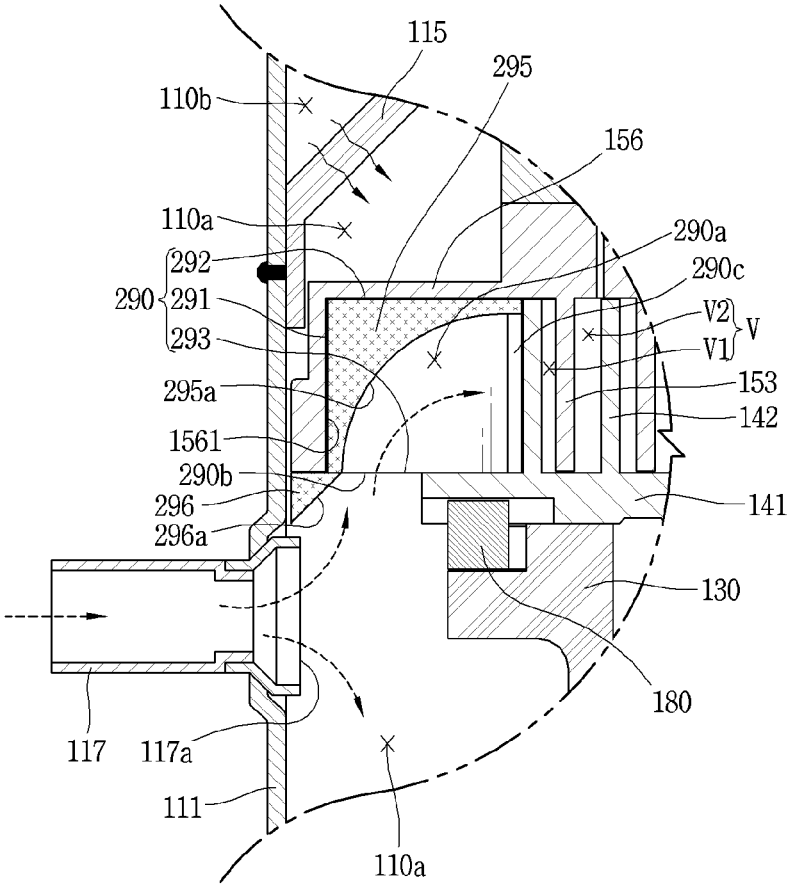
FIG. 27 is a longitudinal sectional view illustrating an assembled state of the suction guide of FIG. 25.

Referring to FIGS. 25 to 27, the basic configuration of the suction guide 290 including the guide accommodating portion 1561 according to this embodiment and operating effects thereof are almost the same as those of the previous embodiments. Therefore, repetitive description thereof has been omitted.

Further, the suction guide 290 according to this embodiment may be, for example, press-fitted, hooked, or screwed to the guide accommodating portion 1561. Furthermore, the suction guide 290 according to this embodiment may be formed such that the inner circumferential surface of the side wall 291 and the lower surface of the upper wall 292 are orthogonal to each other as in the embodiment of FIG. 3, or the first guide 295 having the first guide surface 295*a* is formed between the inner circumferential surface of the side wall 291 and the lower surface of the upper wall 292 as in the embodiment of FIG. 22.

However, in this embodiment, a second guide portion or guide 296 may further be formed to extend from the axial side surface defining the lower surface of the side wall 291 to the outlet end 117*a* of the refrigerant suction pipe 117. The second guide 296 may extend so as to protrude radially more than the outer circumferential surface of the side wall 291.

The second guide 296 may extend in the axial and radial directions to be located between the outlet end 117*a* of the refrigerant suction pipe 117 and the axial side surface of the suction guide protrusion 156 facing the outlet end 117*a*. More specifically, the second guide 296 may extend from the lower end of the side wall 291 toward the refrigerant suction pipe 117 in the axial direction. In other words, the second guide 296 may extend to the outside of the suction passage 290*a* so as to be located between the outlet end 117*a* of the refrigerant suction pipe 117 and the lower end of the non-orbiting scroll 150 facing it in the axial direction, that is, the lower surface of the suction guide protrusion 156.

In addition, the second guide 296 may extend in a radial direction toward the inner circumferential surface of the casing 110. In other words, the second guide 296 may overlap the lower surface of the suction guide protrusion 156 which defines the lower end of the non-orbiting scroll 150 when projected in the axial direction. Accordingly, the second guide 296 may obscure the lower surface of the suction guide protrusion 156 defining the portion of the non-orbiting scroll 150 without closing the passage inlet 290*b* of the suction passage 290*a*.

As described above, when the second guide 296 extends between the refrigerant suction pipe 117 and the non-orbiting scroll 150, the suction refrigerant suctioned into the low-pressure portion 110*a* through the refrigerant suction pipe 117 may quickly move toward the suction passage 290*a* of the suction guide 290 along the second guide 296, thereby improving volumetric efficiency of the compression chamber.

In addition, the second guide 296 may include a second guide surface 296*a* formed on a surface facing the drive motor 120. The second guide surface 296*a* may be inclined or curved toward the passage inlet 290*b* of the suction passage 290*a* from the outlet end 117*a* of the refrigerant suction pipe 117. Accordingly, the suction refrigerant may move more smoothly toward the suction passage 290*a* of the suction guide 290 along the second guide surface 296*a*.

In addition, the outer circumferential surface of the second guide 296 may be in contact with or spaced apart from the inner circumferential surface of the casing 110. When the second guide 296 is in contact with the inner circumferential surface of the casing 110, it may be possible to more effectively suppress the suction refrigerant from moving toward the high/low pressure separation plate 115. On the other hand, when the second guide 296 is spaced apart from the inner circumferential surface of the casing 110, it may be possible to suppress damage to the suction guide 290 due to welding heat during assembling of the casing 110. This may be advantageous in selection of a material for the suction guide 290.

However, when the second guide 296 is spaced apart from the inner circumferential surface of the casing 110, a distance between the casing 110 and the second guide 296 may be shorter than or equal to a depth that the outlet end 117*a* of the refrigerant suction pipe 117 is inserted into the casing 110. For example, where a distance from the inner circumferential surface of the casing 110 to the outer circumferential surface of the second guide 296 is a first interval G1 and a depth from the inner circumferential surface of the casing 110 to the outlet end 117*a* of the refrigerant suction pipe 117 is a second interval G2, the first interval G1 may be smaller than or equal to the second interval G2. Accordingly, the second guide 296 may be located outward than the outlet end 117*a* of the refrigerant suction pipe 117, namely, closer to or at at least the same position as the inner circumferential surface of the casing 110 in the radial direction.

As such, when the second guide 296 extends from the outside of the suction passage 290*a* toward the inner circumferential surface of the casing 110, the suction refrigerant may be blocked by the second guide 296 so as not to flow toward the outer circumferential surface of the suction guide protrusion 156. Accordingly, an amount of refrigerant that flows toward the high/low pressure separation plate 115 through a gap between the inner circumferential surface of the casing 110 and the outer circumferential surface of the suction guide protrusion 156 may be reduced. This may prevent the suction refrigerant from being in contact with the non-orbiting scroll 150 by the second guide 296, thereby suppressing overheating of the suction refrigerant.

This may be effective when applied to a scroll compressor which is a top-compression type and also a non-orbiting scroll back pressure type in which a non-orbiting scroll is pressed toward an orbiting scroll as illustrated in the embodiments disclosed herein. That is, in the case of the top-compression and non-orbiting scroll back pressure type scroll compressor, the non-orbiting scroll 150 must move in the axial direction by back pressure and thus is spaced apart from the inner circumferential surface of the casing 110. Due to this, the suction refrigerant suctioned into the low-pressure portion 110*a* through the refrigerant suction pipe 117 may flow toward the high/low pressure separation plate 115 through the gap between the inner circumferential surface of the casing 110 and the outer circumferential surface of the non-orbiting scroll 150. However, as described above, the second guide 296 may block the suction refrigerant to a certain extent. Accordingly, the suction refrigerant may be suppressed from being overheated by heat of the high-pressure portion 110*b* transferred through the high/low pressure separation plate 115.

Embodiments disclosed herein provide a scroll compressor capable of appropriately cooling a drive motor while reducing a specific volume of suction refrigerant in a low-pressure type. Embodiments disclosed herein further provide a scroll compressor capable of appropriately distributing suction refrigerant passing through a refrigerant suction pipe toward a low-pressure portion of a casing and a compression unit. Embodiments disclosed herein furthermore provide a scroll compressor capable of preventing refrigerant suctioned to a compression unit from being heated by a high/low pressure separation plate.

In embodiments disclosed herein, a high/low pressure separation plate may be disposed to divide an inner space of a casing into a lower space and an upper space. A refrigerant suction pipe may be disposed to communicate with the lower space of the casing. A refrigerant discharge pipe may be disposed to communicate with the upper space of the casing. A compression unit in which a suction pressure chamber is located may be disposed at an upper side of the refrigerant suction pipe. A suction guide may be located between an outlet of the refrigerant suction pipe and the suction pressure chamber of the compression unit. The suction guide may be coupled to the casing or the compression unit facing it. With this configuration, refrigerant flowing into a low-pressure portion of the casing through the refrigerant suction pipe may be distributed by the suction guide, such that a portion of the refrigerant may be directly suctioned into the compression chamber without flowing to the high/low pressure separation plate and another portion of the refrigerant may be guided toward the drive motor to cool the drive motor. This may prevent overheating of the refrigerant suctioned into the compression chamber so as to increase an amount of suction refrigerant and may suppress overheating of the drive motor so as to improve efficiency of the compressor and expand an operation range of the compressor.

The refrigerant guide may be open downward and open toward the suction pressure chamber. With this configuration, the refrigerant flowing into the low-pressure portion of the casing through the refrigerant suction pipe may be distributed by the suction guide, such that a portion of the refrigerant may be directly suctioned into the compression chamber without flowing to the high/low pressure separation plate and another portion of the refrigerant may be guided toward the drive motor to cool the drive motor.

The suction guide may have a shape in which one radial side surface and an upper surface, except for another radial side surface facing the suction pressure chamber, are blocked. Accordingly, radiant heat transmitted through the high/low pressure separation plate may be blocked.

A scroll compressor according to one embodiment may include a casing, a high/low pressure separation plate, a refrigerant suction pipe, a refrigerant discharge pipe, a drive motor, an orbiting scroll, a non-orbiting scroll, and a suction guide. The casing may have a hermetic inner space. The high/low pressure separation plate may separate the inner space of the casing into a low-pressure portion and a high-pressure portion. The refrigerant suction pipe may communicate with the low-pressure portion through the casing. The refrigerant discharge pipe may communicate with the high-pressure portion through the casing. The drive motor may be installed inside of the low-pressure portion. The orbiting scroll may be coupled to the drive motor through a rotational shaft to perform an orbiting motion. The non-orbiting scroll may be engaged with the orbiting scroll to form a compression chamber, and have a suction port formed through an outer circumferential surface thereof to communicate with the compression chamber. The suction guide may include a suction passage to guide refrigerant suctioned into the low-pressure portion toward the compression chamber. The suction guide may include a passage inlet that defines one or a first end of the suction passage and open toward the low-pressure portion, and a passage outlet that defines another or a second end of the suction passage and open toward the suction port. The passage inlet may be open in an intersecting direction with an outlet end of the refrigerant suction pipe. With this configuration, refrigerant flowing into the low-pressure portion of the casing through the refrigerant suction pipe may be distributed by the suction guide, such that a portion of the refrigerant may be directly suctioned into the compression chamber without flowing to the high/low pressure separation plate and another portion of the refrigerant may be guided toward the drive motor to cool the drive motor.

The outlet end of the refrigerant suction pipe may be open in a radial direction and the passage inlet of the suction guide may be open in an axial direction. With this configuration, the refrigerant flowing into the low-pressure portion of the casing may be appropriately distributed toward the compression chamber and the drive motor by the suction guide.

The passage inlet may be located at an opposite side of the drive motor with respect to the outlet end of the refrigerant suction pipe. With this configuration, the refrigerant suctioned into the low-pressure portion of the casing may move not only to the compression chamber but also to the drive motor, thereby increasing an amount of refrigerant suctioned into the compression chamber and suppressing overheating of the drive motor.

The suction guide may be formed in a direction in which the passage inlet and the passage outlet intersect with each other. Accordingly, a passage connection portion may be located in a direction intersecting with the refrigerant suction pipe.

The passage inlet may be open in a direction toward the drive motor and the passage outlet may be open in a direction toward an outer circumferential surface of the non-orbiting scroll.

The suction guide may include a first side wall portion or wall, a second side wall portion or wall, an outer wall portion or wall, an inner wall portion or wall, an upper wall portion or wall, and a lower wall portion or wall. The first side wall portion and the second side wall portion may be disposed respectively at both sides of the suction port in the circumferential direction. The outer wall portion may connect an outer end of the first side wall portion and an outer end of the second side wall portion. The inner wall portion may connect an inner end of the first side wall portion and an inner end of the second side wall portion. The upper wall portion may connect upper ends of the first side wall portion, the second side wall portion, and the outer wall portion. The lower wall portion may connect lower ends of the first side wall portion, the second side wall portion, and the outer wall portion. The passage inlet may be formed by opening at least a portion of the lower wall portion, and the passage outlet may be formed by opening at least a portion of the inner wall portion. With this configuration, the passage inlet may be formed in an intersecting direction with the refrigerant suction pipe and also an area of the passage inlet may be secured.

A stepped portion or step may be formed on an outer circumferential surface of the non-orbiting scroll. A fixing protrusion may extend in a circumferential direction from at least one of the first side wall portion or the second side wall portion to be supported on the stepped portion of the non-orbiting scroll. This may allow the suction guide to be fixed to the non-orbiting scroll easily and stably.

The scroll compressor may further include a suction extension portion that extends from the first side wall portion and the second side wall portion toward the drive motor. The suction extension portion may at least partially overlap the outlet end of the refrigerant suction pipe in axial and radial directions. This may increase an amount of refrigerant suctioned into the compression chamber.

The suction extension portion may be formed such that a first interval from a lower end thereof facing the drive motor to an inner circumferential surface of the casing is smaller than a second interval from an upper end thereof in contact with the passage inlet to the inner circumferential surface of the casing. Accordingly, suction refrigerant may be smoothly introduced into the compression chamber.

The suction extension portion may be inclined from a lower end thereof facing the drive motor to an upper end thereof in contact with the passage inlet, so as to be gradually extend away from an inner circumferential surface of the casing. Accordingly, the suction refrigerant may be more smoothly introduced into the compression chamber.

A thickness of the upper wall portion may be thicker than a thickness of portions other than the upper wall portion. This may more effectively block radiant heat from the high/low pressure separation plate.

At least a portion of one of the first side wall portion or the second side wall portion may be open to form a suction hole defining a portion of the passage inlet. With this configuration, the passage inlet may also be formed at a side surface, so that refrigerant may be smoothly suctioned into the compression chamber.

The outer wall portion may be curved so that an outer circumferential surface thereof may be in close contact with the inner circumferential surface of the casing. This may minimize a gap between the casing and the suction guide, thereby suppressing refrigerant from flowing toward the high/low pressure separation plate without flowing to the suction guide.

The scroll compressor may further include a main frame disposed between the drive motor and the non-orbiting scroll to support the orbiting scroll. The non-orbiting scroll may include a plurality of guide protrusions supported by the main frame and disposed at preset or predetermined intervals in a circumferential direction. One of the plurality of guide protrusions may be provided with a suction guide groove recessed from an outer circumferential surface thereof to an inner circumferential surface thereof by a preset or predetermined depth. The suction guide may be accommodated in a space between both circumferential inner surfaces defining the suction guide groove. This may stably support the suction guide and block a gap between the non-orbiting scroll and the suction guide, thereby suppressing refrigerant from flowing toward the high/low pressure separation plate without flowing to the suction guide.

The outer wall portion may further include sealing extension portions that extend in a circumferential direction from an outer surface of the first side wall portion and an outer surface of the second side wall portion. This may block a gap between the casing and the non-orbiting scroll, thereby suppressing refrigerant from flowing toward the high/low pressure separation plate without moving to the suction guide.

The suction guide may be formed of a material having lower thermal conductivity than that of the non-orbiting scroll. This may increase an insulation effect of the suction guide, so as to prevent refrigerant from being heated by radiant heat transmitted through the high/low pressure separation plate.

Embodiments disclosed herein provide a scroll compressor that may include a casing, a high/low pressure separation plate, a refrigerant suction pipe, a refrigerant discharge pipe, a drive motor, an orbiting scroll, a non-orbiting scroll, and a suction guide. The high/low pressure separation plate may divide an inner space of the casing into a low-pressure part or portion and a high-pressure part or portion. The refrigerant suction pipe may communicate with the low-pressure part through the casing. The refrigerant discharge pipe may communicate with the high-pressure part through the casing. The drive motor installed inside of the low-pressure part. The orbiting scroll may be coupled to the drive motor through a rotational shaft to perform an orbiting motion. The non-orbiting scroll may be engaged with the orbiting scroll to form a compression chamber, and have a suction port that communicates with the compression chamber. The non-orbiting scroll may include a suction guide protrusion that accommodates the suction port and extends radially toward an inner circumferential surface of the casing. A suction guide may be inserted into the suction guide protrusion to guide refrigerant suctioned into the low-pressure part toward the compression chamber. With this configuration, a portion of suction refrigerant flowing into the low-pressure part of the casing through the refrigerant suction pipe may be suctioned into the compression chamber in advance before flowing toward the high/low pressure separation plate through the suction guide protrusion and the suction guide, so as to be prevented from being overheated, thereby increasing an amount of refrigerant suctioned. Also, another portion of the suction refrigerant may cool the drive motor without moving directly to the suction guide protrusion and the suction guide, thereby improving efficiency of the compressor and expanding an operation range of the compressor.

The suction guide protrusion may include a guide accommodating portion recessed from the drive motor toward the high/low pressure separation plate. The suction guide may include a suction passage that communicates between the outlet end of the refrigerant suction pipe and the suction port and may be inserted into the guide accommodating portion. This may facilitate formation of a refrigerant guide portion or guide that guides suction refrigerant to the compression chamber and effectively suppress overheating of the suction refrigerant.

More specifically, the suction guide may include a passage inlet that defines one or a first end of the suction passage and open toward the low-pressure part and a passage outlet that defines another or a second end of the suction passage and open toward the suction port. The passage inlet may be open in an intersecting direction with the outlet end of the refrigerant suction pipe. With this configuration, the suction refrigerant may be appropriately distributed and moved not only to the compression chamber but also to the drive motor.

More specifically, the outlet end of the refrigerant suction pipe may be open in a radial direction and the passage inlet of the suction guide may be open at one side of the refrigerant suction pipe in an axial direction. As the outlet end of the refrigerant suction pipe and the suction guide are disposed so as not to face each other, the suction refrigerant may be appropriately distributed and moved toward the compression chamber and the drive motor.

The suction guide may include a side wall portion or wall that extends radially from both circumferential sides of the suction port with accommodating the suction port, an upper wall portion or wall that defines one or a first axial side surface of the side wall portion facing the high/low pressure separation plate, and a lower wall portion or wall that defines another or a second axial side surface of the side wall portion facing the drive motor. The upper wall portion may cover the one axial side surface of the side wall portion to define the suction passage together with the side wall portion, the lower wall portion may be at least partially open to define the passage inlet, and the side wall portion may partially be open toward the suction port to define the passage outlet. Accordingly, the passage inlet and the passage outlet of the suction guide may be located adjacent to each other, so that the refrigerant suctioned into the low-pressure part may be quickly suctioned into the compression chamber.

More specifically, the suction guide may be formed as a single body. This may facilitate manufacturing of the suction guide.

The scroll compressor may further include a first guide portion or guide that protrudes by a preset or predetermined height between an inner circumferential surface of the side wall portion and an inner circumferential surface of the upper wall portion at a side facing the passage outlet. The first guide portion may have a first guide surface curved or inclined toward the passage outlet. This may allow the refrigerant to be quickly suctioned into the compression chamber without a delay in the suction passage, thereby enhancing volumetric efficiency of the compression chamber.

The scroll compressor may further include a second guide portion or guide that extends from the other axial side surface of the side wall portion toward the outlet end of the refrigerant suction pipe. At least a portion of the second guide portion may overlap the first guide portion in the radial direction when projected in the axial direction. Therefore, the suction refrigerant of the low-pressure part may be quickly introduced into the suction guide along the second guide portion, and simultaneously quickly suctioned into the compression chamber as the second guide portion is disposed consecutively with the first guide portion.

The second guide portion may protrude more than the outer circumferential surface of the side wall portion in the radial direction to be located between the outlet end of the refrigerant suction pipe and the one axial side surface of the suction guide protrusion facing the outlet end. The second guide portion may have a second guide surface inclined or curved from the outlet end of the refrigerant suction pipe toward the non-orbiting scroll. This may allow the suction refrigerant of the low-pressure part to be more rapidly suctioned into the suction guide along the second guide surface. In addition, the suction guide may block the suction guide protrusion so as to suppress the suction refrigerant of the low-pressure part from being in contact with a lower surface of the suction guide protrusion, thereby preventing overheating of the suction refrigerant more effectively.

The scroll compressor may further include a second guide portion or guide that extends from the other axial side surface of the side wall portion toward the outlet end of the refrigerant suction pipe. The second guide portion may protrude more than the outer circumferential surface of the side wall portion in the radial direction to be located between the outlet end of the refrigerant suction pipe and the one axial side surface of the suction guide protrusion facing the outlet end. With this configuration, the suction refrigerant of the low-pressure part may rapidly move into the suction guide along the second guide portion, and simultaneously may be suppressed from being in contact with the suction guide protrusion of the non-orbiting scroll, thereby preventing overheating of the refrigerant.

The second guide portion may have a second guide surface disposed on a surface facing the drive motor to be inclined or curved from the outlet end of the refrigerant suction pipe toward the passage inlet of the suction passage. Accordingly, the suction refrigerant of the low-pressure part may be more quickly introduced into the suction guide.

The non-orbiting scroll may be separated from the inner circumferential surface of the casing. A first interval from the inner circumferential surface of the casing to the outer circumferential surface of the second guide portion may be smaller than or equal to a second interval from the inner circumferential surface of the casing to the outlet end of the refrigerant suction pipe. With this configuration, as the second guide portion may block a gap between the inner circumferential surface of the casing and an outer circumferential surface of the non-orbiting scroll, the suction refrigerant of the low-pressure part may be effectively suppressed from flowing toward the high/low pressure separation plate through the gap between the casing and the non-orbiting scroll.

At least a portion of the suction guide may overlap the orbiting scroll when projected in the axial direction. Accordingly, the suction guide may be supported in the axial direction by the orbiting scroll, thereby preventing deterioration of assembly reliability.

The outer circumferential surface of the suction guide may be coupled in contact with the inner circumferential surface of the suction guide protrusion. This may simplify an assembly structure between the suction guide and the suction guide protrusion and also allow close coupling between the suction guide and the suction guide protrusion, thereby improving assembly reliability of the suction guide and suppressing generation of abnormal noise between the suction guide and the suction guide protrusion.

One of the suction guide or the suction guide protrusion may be provided with a protrusion and the other may be provided with a groove in which the protrusion is inserted. This may facilitate the suction guide to be coupled to the suction guide protrusion and also increase a coupling force between the suction guide and the suction guide protrusion, thereby preventing friction loss and interference with the orbiting scroll due to separation of the suction guide.

More specifically, the suction guide may be coupled to the suction guide protrusion by a fastening member. This may facilitate the suction guide to be coupled to the suction guide protrusion and also increase a coupling force between the suction guide and the suction guide protrusion, thereby preventing friction loss and interference with the orbiting scroll due to separation of the suction guide.

The suction guide may be formed of a material having a lower thermal conductivity than that of the non-orbiting. This may increase an insulation effect of the suction guide, so as to effectively prevent the suction refrigerant from being heated by radiant heat transmitted from the high-pressure portion to the low-pressure portion through the high/low pressure separation plate.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a casing;

a high/low pressure separation plate configured to divide an inner space of the casing into a low-pressure portion and a high-pressure portion;

a refrigerant suction pipe that communicates with the low-pressure portion through the casing;

a refrigerant discharge pipe that communicates with the high-pressure portion through the casing;

a drive motor installed inside of the low-pressure portion;

an orbiting scroll coupled to the drive motor through a rotational shaft to perform an orbiting motion;

a non-orbiting scroll engaged with the orbiting scroll to form a compression chamber, and having a suction port formed through an outer circumferential surface thereof to communicate with the compression chamber; and a suction guide having a suction passage to guide refrigerant suctioned into the low-pressure portion toward the compression chamber, wherein the suction guide comprises a passage inlet that defines a first end of the suction passage and open toward the low-pressure portion, and a passage outlet that defines a second end of the suction passage and open toward the suction port, wherein the passage inlet is open in a direction extending perpendicular with respect to an outlet end of the refrigerant suction pipe, wherein the non-orbiting scroll comprises a suction guide protrusion that accommodates the suction port and extends radially toward an inner circumferential surface of the casing, wherein the suction guide protrusion includes a guide accommodating portion recessed from the drive motor toward the high/low pressure separation plate so as to being open toward the drive motor, and wherein the suction guide that guides the refrigerant suctioned into the low-pressure portion into the compression chamber is inserted into the guide accommodating portion of the suction guide protrusion.

2. The scroll compressor of claim 1, wherein the outlet end of the refrigerant suction pipe is open in a radial direction of the scroll compressor, and the passage inlet of the suction guide is open in an axial direction of the scroll compressor.

3. The scroll compressor of claim 1, wherein the passage inlet is located at an opposite side from the drive motor with respect to the outlet end of the refrigerant suction pipe.

4. The scroll compressor of claim 1, wherein the suction guide is configured such that the passage inlet and the passage outlet intersect with each other, wherein the passage inlet is open in a direction toward the drive motor, and wherein the passage outlet is open in a direction toward an outer circumferential surface of the non-orbiting scroll.

5. The scroll compressor of claim 1, wherein the suction guide comprises a suction passage that communicates between the outlet end of the refrigerant suction pipe and the suction port and is inserted into the guide accommodating portion.

6. The scroll compressor of claim 1, wherein the suction guide comprises a side wall that extends radially from both circumferential sides of the suction port and accommodates the suction port, an upper wall that defines a first axial side surface of the side wall facing the high/low pressure separation plate, and a lower wall that defines a second axial side surface of the side wall facing the drive motor, and wherein the upper wall covers the first axial side surface of the side wall to define the suction passage together with the side wall, the lower wall is at least partially open to define the passage inlet, and the side wall is partially open toward the suction port to define the passage outlet.

7. The scroll compressor of claim 6, wherein a first guide protrudes by a predetermined height between an inner circumferential surface of the side wall and an inner circumferential surface of the upper wall at a side facing the passage outlet, and wherein the first guide comprises a first guide surface curved or inclined toward the passage outlet.

8. The scroll compressor of claim 7, wherein a second guide extends from the second axial side surface of the side wall toward the outlet end of the refrigerant suction pipe, wherein the second guide at least partially overlaps the first guide in a radial direction of the scroll compressor when projected in the axial direction, and protrudes more than an outer circumferential surface of the side wall in the radial direction to be located between the outlet end of the refrigerant suction pipe and the first axial side surface of the suction guide protrusion facing the outlet end, and wherein the second guide comprises a second guide surface inclined or curved from the outlet end of the refrigerant suction pipe toward the non-orbiting scroll.

9. The scroll compressor of claim 7, wherein a second guide extends from the second axial side surface of the side wall toward the outlet end of the refrigerant suction pipe, wherein the second guide protrudes more than an outer circumferential surface of the side wall in a radial direction of the scroll compressor to be located between the outlet end of the refrigerant suction pipe and the first axial side surface of the suction guide protrusion facing the outlet end, and wherein the second guide comprises a second guide surface inclined or curved from the outlet end of the refrigerant suction pipe toward the passage inlet.

10. The scroll compressor of claim 7, wherein the non-orbiting scroll is spaced apart from the inner circumferential surface of the casing, wherein a second guide extends from the second axial side surface of the side wall toward the outlet end of the refrigerant suction pipe, wherein the second guide protrudes more than an outer circumferential surface of the side wall in a radial direction of the scroll compressor to be located between the outlet end of the refrigerant suction pipe and the first axial side surface of the suction guide protrusion facing the outlet end, and wherein a first interval from the inner circumferential surface of the casing to an outer circumferential surface of the second guide is smaller than or equal to a second interval from the inner circumferential surface of the casing to the outlet end of the refrigerant suction pipe.

11. The scroll compressor of claim 1, wherein an outer circumferential surface of the suction guide is coupled in contact with an inner circumferential surface of the suction guide protrusion, or wherein one of the suction guide or the suction guide protrusion is provided with a protrusion and the other is provided with a groove in which the protrusion is inserted, or wherein the suction guide is coupled to the suction guide protrusion by a fastening member.

12. The scroll compressor of claim 1, wherein the suction guide is made of a material having a lower thermal conductivity than that of the non-orbiting scroll.

13. A scroll compressor, comprising:

a casing;

a high/low pressure separation plate configured to divide an inner space of the casing into a low-pressure portion and a high-pressure portion;

a refrigerant suction pipe that communicates with the low-pressure portion through the casing;

a refrigerant discharge pipe that communicates with the high-pressure portion through the casing;

a drive motor installed inside of the low-pressure portion;

an orbiting scroll coupled to the drive motor through a rotational shaft to perform an orbiting motion;

a non-orbiting scroll engaged with the orbiting scroll to form a compression chamber, and having a suction port formed through an outer circumferential surface thereof to communicate with the compression chamber; and a suction guide having a suction passage to guide refrigerant suctioned into the low-pressure portion toward the compression chamber, wherein the suction guide comprises a passage inlet that defines a first end of the suction passage and open toward the low-pressure portion, and a passage outlet that defines a second end of the suction passage and open toward the suction port, wherein the passage inlet is open in a direction extending perpendicular with respect to an outlet end of the refrigerant suction pipe, wherein the suction guide comprises:

a first side wall and a second side wall disposed at both sides of the suction port in a circumferential direction, respectively;

an outer wall that connects an outer end of the first side wall and an outer end of the second side wall;

an inner wall that connects an inner end of the first side wall and an inner end of the second side wall;

an upper wall that connects upper ends of the first side wall, the second side wall, and the outer wall; and a lower wall that connects lower ends of the first side wall, the second side wall, and the outer wall, and wherein the passage inlet is formed by opening at least a portion of the lower wall, and the passage outlet is formed by opening at least a portion of the inner wall, wherein the upper wall faces the high/low pressure separation plate, and wherein a thickness of the upper wall is thicker than a thickness of the other walls of the suction guide.

14. The scroll compressor of claim 13, wherein a step is formed on an outer circumferential surface of the non-orbiting scroll, and wherein a fixing protrusion extends in a circumferential direction from at least one of the first side wall or the second side wall to be supported on the step of the non-orbiting scroll.

15. The scroll compressor of claim 13, wherein a suction extension portion extends from the first side wall and the second side wall toward the drive motor, and wherein the suction extension portion at least partially overlaps the outlet end of the refrigerant suction pipe in a radial direction.

16. The scroll compressor of claim 15, wherein the suction extension portion is inclined from a lower end thereof facing the drive motor to an upper end thereof in contact with the passage inlet, so as to gradually extend away from an inner circumferential surface of the casing.

17. The scroll compressor of claim 13, wherein at least a portion of one of the first side wall or the second side wall is open to form a suction hole defining a portion of the passage inlet.

18. The scroll compressor of claim 13, wherein a main frame that supports the orbiting scroll is disposed between the drive motor and the non-orbiting scroll, wherein the non-orbiting scroll comprises a plurality of guide protrusions supported by the main frame and disposed at predetermined intervals in a circumferential direction of the non-orbiting scroll, wherein one of the plurality of guide protrusions is provided with a suction guide groove recessed from an outer circumferential surface thereof to an inner circumferential surface thereof by a predetermined depth, wherein the suction guide is accommodated in a space between circumferential inner surfaces defining the suction guide groove, and wherein the outer wall comprises sealing extension portions that extend in the circumferential direction from an outer surface of the first side wall and an outer surface of the second side wall.

19. A scroll compressor, comprising:

a casing;

a high/low pressure separation plate configured to divide an inner space of the casing into a low-pressure portion and a high-pressure portion;

a refrigerant suction pipe that communicates with the low-pressure portion through the casing;

a refrigerant discharge pipe that communicates with the high-pressure portion through the casing;

a drive motor installed inside of the low-pressure portion;

an orbiting scroll coupled to the drive motor through a rotational shaft to perform an orbiting motion;

a non-orbiting scroll engaged with the orbiting scroll to form a compression chamber, and having a suction port formed through an outer circumferential surface thereof to communicate with the compression chamber; and a suction guide having a suction passage to guide refrigerant suctioned into the low-pressure portion toward the compression chamber, wherein the suction guide comprises a passage inlet that defines a first end of the suction passage and open toward the low-pressure portion, and a passage outlet that defines a second end of the suction passage and open toward the suction port, wherein the outlet end of the refrigerant suction pipe is open in a radial direction of the scroll compressor, and the passage inlet of the suction guide is open in an axial direction of the scroll compressor, wherein the passage inlet is located at an opposite side from the drive motor with respect to the outlet end of the refrigerant suction pipe, wherein the suction guide comprises:

a first side wall and a second side wall disposed at both sides of the suction port in a circumferential direction, respectively;

an outer wall that connects an outer end of the first side wall and an outer end of the second side wall;

an inner wall that connects an inner end of the first side wall and an inner end of the second side wall;

an upper wall that connects upper ends of the first side wall, the second side wall, and the outer wall; and a lower wall that connects lower ends of the first side wall, the second side wall, and the outer wall, and wherein the passage inlet is formed by opening at least a portion of the lower wall, and the passage outlet is formed by opening at least a portion of the inner wall, and wherein a suction extension portion extends from the first side wall and the second side wall toward the drive motor, wherein the suction extension portion at least partially overlaps the outlet end of the refrigerant suction pipe in a radial direction, and wherein the suction extension portion is spaced apart from an inner circumferential surface of the casing.

* * * * *